US011564480B2

(12) United States Patent
Ruddy

(10) Patent No.: US 11,564,480 B2
(45) Date of Patent: Jan. 31, 2023

(54) PRODUCT CONTAINERS FOR INTEGRATION WITH DEVICES AND ACCESSORIES

(71) Applicant: Reliant Products LLC, Rye, NY (US)

(72) Inventor: Jeff Ruddy, Rye, NY (US)

(73) Assignee: RELIANT PRODUCTS LLC, Rye, NY (US)

( * ) Notice: Subject to any disclaimer, the term of this patent is extended or adjusted under 35 U.S.C. 154(b) by 488 days.

(21) Appl. No.: 16/518,252

(22) Filed: Jul. 22, 2019

(65) Prior Publication Data

US 2020/0253362 A1 Aug. 13, 2020

Related U.S. Application Data

(60) Provisional application No. 62/802,935, filed on Feb. 8, 2019.

(51) Int. Cl.
*A45F 5/00* (2006.01)

(52) U.S. Cl.
CPC ..... *A45F 5/00* (2013.01); *A45F 2005/002* (2013.01); *A45F 2200/0516* (2013.01)

(58) Field of Classification Search
CPC ..... A45F 5/00; A45F 2005/002; A45F 2200/0516; A45F 2005/1086; A45F 2005/026; A45F 2005/025; A45D 40/18; A45D 33/26; A45D 33/28; H04M 1/21; A45C 15/04; A45C 2011/002; A45C 15/00; A45C 11/008; B65D 51/18; H01R 13/625; F16B 2/12; F16B 3/00
USPC .... 224/212, 254.1, 744; 206/320, 45.2, 576, 206/581; 248/220.21, 220.41, 221.11, 248/222.13, 222.52, 223.41, 224.61
See application file for complete search history.

(56) References Cited

U.S. PATENT DOCUMENTS 2,588,611 A * 3/1952 Breen ..... A45D 33/28 132/297
2,889,451 A * 6/1959 Longo ..... F21S 4/10 248/314

(Continued)

FOREIGN PATENT DOCUMENTS

KR 10-133564 11/2013
KR 101331564 11/2013

(Continued)

OTHER PUBLICATIONS

Jae, KR2016-29323A, Oct. 2014 (Year: 2014).*
International Search Report dated Oct. 30, 2020 PCT/US2020/042901.

*Primary Examiner* — Adam J Waggenspack
(74) *Attorney, Agent, or Firm* — Leason Ellis LLP

(57) ABSTRACT

The invention provides a product container grip comprising a container wall forming a cavity, a container top releasably attached to said container wall, a container bottom integral with said container wall, a locking mechanism disposed at least in part in said container wall, and a locking mechanism provides a means for releasably locking/attaching said container onto an extendable handle. Also provided is a container having a bottom or side locking mechanism for locking/attaching onto an extendable handle or locking/attaching onto an adapter fitted with receiving structures for accepting and forming a seal with the product container grip.

19 Claims, 28 Drawing Sheets

(56) References Cited

U.S. PATENT DOCUMENTS 4,498,608 A * 2/1985 Mercil ..... B65D 51/30 222/196.1
5,054,505 A * 10/1991 Yuhara ..... A45D 40/18 132/304
7,236,588 B2 * 6/2007 Gartrell ..... H04M 1/0283 455/90.3
7,431,161 B2 * 10/2008 Carlino ..... B65D 69/00 132/316
8,499,933 B2 * 8/2013 Ziemba ..... A45D 33/26 206/320
8,560,031 B2 * 10/2013 Barnett ..... F16M 13/00 455/575.8
8,737,066 B1 * 5/2014 Block ..... A45F 5/00 361/679.59
8,833,379 B1 * 9/2014 Kaplan ..... A45D 33/26 206/823
9,221,582 B2 * 12/2015 Wheeler ..... B65D 21/086
9,533,448 B2 * 1/2017 Sanders ..... B64D 45/00
9,681,732 B2 * 6/2017 Winter ..... A45F 3/16
9,787,348 B2 * 10/2017 Srour ..... H04M 1/15
9,804,636 B2 * 10/2017 Barnett ..... A63F 13/92
9,958,107 B1 * 5/2018 Hobbs ..... F16M 13/00
10,200,518 B2 * 2/2019 Richter ..... H04M 1/04
10,408,522 B2 * 9/2019 Tsui ..... B65D 21/086
10,595,611 B2 * 3/2020 Berkley ..... A45C 13/005
2006/0091222 A1 * 5/2006 Leung ..... G06F 1/166 235/486
2009/0044825 A1 * 2/2009 Lawrence ..... A45F 5/00 206/581
2011/0077061 A1 * 3/2011 Danze ..... H04M 1/185 455/575.1
2012/0329534 A1 12/2012 Barnett et al.
2014/0221058 A1 * 8/2014 Jand ..... H04M 1/0283 455/575.8
2018/0348541 A1 * 12/2018 Radzwill ..... A45C 11/00
2019/0072998 A1 * 3/2019 Hwang ..... G06F 1/1626
2019/0138052 A1 * 5/2019 Barnett ..... F16M 11/041
2020/0037737 A1 * 2/2020 Cantoli-Alves ..... H04M 1/04

FOREIGN PATENT DOCUMENTS

KR 20-20170003703 10/2017
KR 2020170003703 10/2017

* cited by examiner

SECTION VIEW

Open on Pop Socket

SECTION VIEW

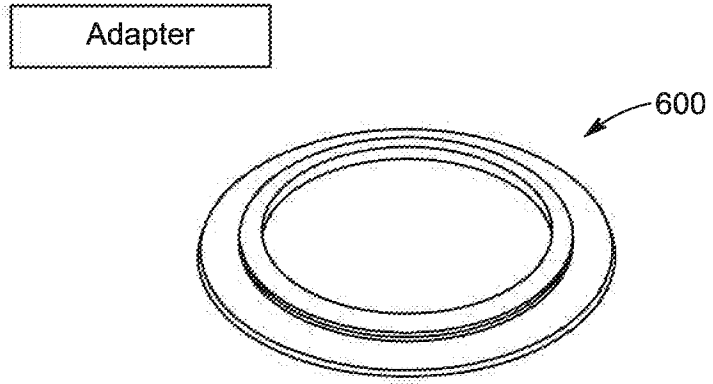
FIG. 14B
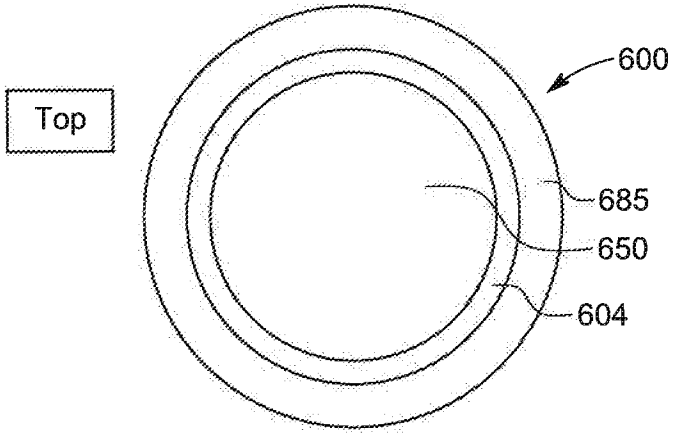
FIG. 14A
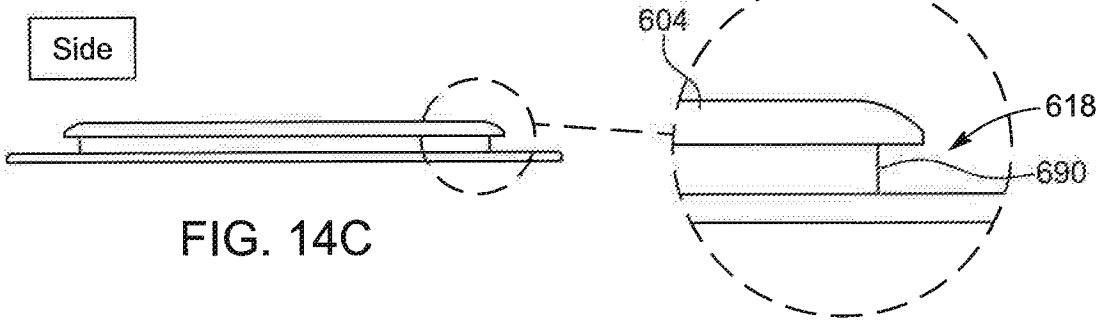
FIG. 14C
FIG. 14D
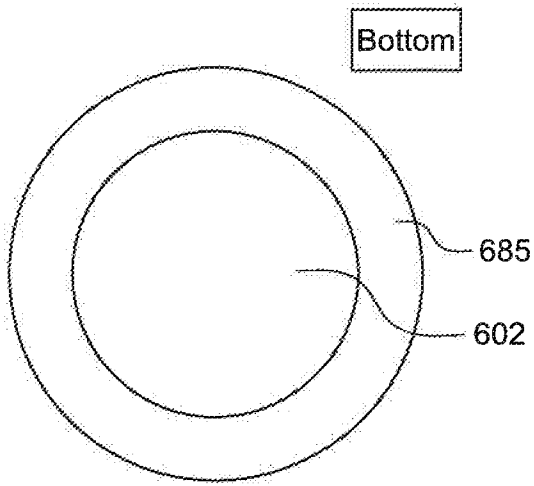
FIG. 14E

SECTION VIEW

Open on Adapter

SECTION VIEW

SECTION VIEW

SECTION VIEW

SECTION VIEW

SECTION VIEW

PRODUCT CONTAINERS FOR INTEGRATION WITH DEVICES AND ACCESSORIES

This application claims priority to and incorporates fully herein by reference, U.S. Provisional Patent Application No. 62/802,935, filed Feb. 8, 2019.

FIELD OF INVENTION

The invention described and claimed herein relates to a product container grip that attaches to or are integral with extendable handles, adapters and other objects.

BACKGROUND

This disclosure is directed generally to product containers. Many people enjoy carrying a product, such as a cosmetic product (e.g., lip balm, lip gloss, blush, dental floss, etc.) with them throughout the day, to apply or otherwise use the product on the go. Many products are contained in lidded, disc shaped containers. These containers are small, and thus they tend to get lost in a user's purse or pocket space. Many users also carry with them a mobile device having an accessory, such as an extendable handle, for facilitating handling of the mobile device. It can be cumbersome, however, for the user to carry both their mobile device with extendable handle as well as a product container. To facilitate handling of and access to the product, needed is a product container that can be integrated with a mobile device or other accessory.

The art discloses a variety of containers and packaging products. See for example: Alameda Packaging—https://www.alamedapackaging.com/Catalog/Jars/128/Plastic Jars.html; Alibaba—https://www.alibaba.com/showroom/lip-balm-container.html; Arminak Associates—http://www.arminak-associates.com /product.aspx?menu=P&mod=SS&cat=COSMETICS&subcat=CLBALM&item= http://www.arminak-associates.com/product.aspx?menu=P&mod=SS&cat=JAR&subcat=ALL_JAR& subsubcat= &item=&Page=1; Berlin Packaging—https://www.berlinpackaging.com/plastic-jars/, https.//www.berlinpackaging.com/flipz-child-resistant-pop-top-jars/; Bulk Apothecary—https: //www.bulkapothecary.com/categories/containers/plastic-jars/; Container & Packaging—https://www.containerandpackaging.com/catalog/plastic-containers/plastic-jars, https://www.containerandpackaging.com/products/88/pet-single-wall-jar/J050); CosmoPak—http://www.cosmopak.com/catalogue/, http://www.cosmopak. com/product-category/jars-pots/; DH Gate—https://www.dhgate.com/manufacturers/empty-lip-balm-containers-supplies.html; Elements Bath & Body—https://www.elementsbathandbody.com/Jars/: Fillmore Contain- er—https: //www.fillmorecontainer.com/containers.html, https://fillmorecontainer.com/closures.html; Global Sources—https: //www.globalsources.com/gsol/GeneralMana- ger?point_search=on&page=search%2FProductSearchResults&product_search=on&supplier_search=off&article_search=off&apclick=&qType=PRODUCT&type=new&query=lip+balm+containers&language=en&point_id=30000001496-81& catalog_id=2000000002844&from=&loc=t&AGG=N&view=grid&KWSearchType=ProdSearch&action=GetPoint&action=Dofree TextSearch; Google Search—https://www.google.com/search?q=lip+balm+grip+jar&source=inms&tbm=isch&sa=X&ved=OahUKEwiki pPXk fiAhXBx1kKHVgVBP0Q_AUIESgC&biw=1536&bih=754, https;//www.google.com/search?g=lip+balm+grip+jar&source=inms&tbm=isch&sa=X&ved=OahUKEwiki pPXk·fiAhXBx1kKHVgVBP0Q_AUIESgC&biw=1536&bih=754, https://www.google.com/search?biw=1536&bih=754&tbm=isch&sa=1&ei=CZ8CXaXJluy2g-geF-pCQCw&g=lip+balm+living+hinge+container&oq=lip+balm+living+hinge+container&gs_l=img.3...6824.10378..10716...0.0..0.220.1709.21j1ji.....0....1..gws-wiz-img.....35i39j0i67j0j0i30j0i8i30.Ey-2cMNYQ70, https://www.google.com/search?biw=1536&bih32754&tbm=isch&sa=1&ei=HZ8CXaeuGJCJggfBjpGQAQ& q=lip+balm+living+hinge+jar&oq=lip+balm+living+hinge+jar&gs_l=img.3...13453.13861..14044...0.0..0.6 7.191.3.....0....1..gws-wiz-img.4WPXhHMGrXs, https://www.google.com/search?biw=1536&bih=754&tbm=isch&sa=1&ei=LJ8CXayUBqjv_Qa8rqOwCg& q=snap+base+jar&oq=snap+base+jar&gs_l=img.3...8002.10325..10601...0.0..0.81.814.13.....0....1..gws-wiz-img..... 0j0167j0i10j01513-0j0i8i30j0i24.GPObox7AjhE, https://www.google.com/search?biw=1536&bih=754&tbm=isch&sa=1&ei=HqAC-XZyvl6Xr_QamqK7YCw &q=small+plastic+jar&oq=small+plastic+jar&gs_l=img.3..0l2j0i8i30j0i2415.4333.4677..4879...0.0..0.60.16 9.3.....0....1..gws-wiz-img.B90LdnUlelM; Lotta Luv—https: //www.google.com/search?q=phone+stand+and+lip+balm&tbm=isch&source=univ&sa=X&ved=2a hUKEwiBypy03eniAhX-HjVkKHbpJBZkQsAR6BAgGEAE&biw=1536&bjh=754#imgrc=jjyWKn4RkRhcvM:, https://www.google.com/search?q=phone+stand+and+lip+balm&tbm=isch&source=univ&sa=X&ved=2ahUKEwiBypy03enjAhXH-jVkKHbpJBZkQsAR6BAgGEAE&biw=1536&bih=754#imgdii=paK-rkhItfMftM:&imgrc=JJyWKn4RkRhcvM:; McKernan—https://www.mckernan.com/wholesale-bulk/plastic-jars/ej-30385, https://www.mckernan.com/wholesale-bulk/plastic-jars/ej-33825, https://www.mckernan.com/wholesle-bulk/plastic-jars?group=ej; MJS Packaging—https://www.mjspackaging.com/products/plastic-containers; Packaging Cosmetics—https: //www.packagingcosmetics.com/product-category/cosmetics-accessories/powder-jars/, https://www.packagingcosmetics.com/product-category/jars/; Premi Spa—https: //www.premispa.com/en/catalogue/p-collection/skin-care/jars/acrylic-jars/; SKS Bottle—https://www.sks-bottle.com/Lip_Balm/Lip_Balm.html, https://www.sks-bottle.com /Lip_Balm/Lip_BalmJars6.html, https://www.sks-bottle.com/340c/fin24c.html, https://www.sks-bottle.com/340c/fin69e.html, https://www.sks-bottle.com/340c/fin69.html, https://www.sks-bottle.com/Cosmetic-Containers3.html, https://www.sks-bottle.com / 340c/fin34g.html, https://www.sks-bottle.com/340c/fin128a.html, https://www.sks-bottle.com /EyeshadowVials.html, https://www.sks-bottle.com/340c/fin24k.html, https://www.sks-bottle.com /MakeupContatners.html; ThePkgCo—https://www.thePkgco.com/product-category/jars/, Uline—https://www.uline.com/, https://www.uline.com/BL_2373/Double-Wall-Dome-Jars, https://www.uline.com/Grp_287/Jars, https://www.uline.com/BL_194/Plastic-Vials, https://www.uline.com/BL_8194/Replacement-Caps; With Logos—https://www.withlogos.com/lip-balm-mirror-compact.

Other products in the art include the EOS IPHONE POP SOCKET, LIP PIC by Latta Luv, see https://www/vinted-.com/women/tech-accessories/25102181-phone-stand-with-mirror-and-lip-gloss. However, these products suffer from drawbacks as compare to the present invention. The present invention in an embodiment provides a container that attaches to an extendable handle (ie PopSocket®, Spin-Pop®, PopGrip® or other extendable handle), adapter) or other surface. The present invention is unique and different from the prior art product because of the containers integrated locking mechanisms. For example, the present invention provides an embodiment that attaches to an extendable handle, adapter or other surface by specialized locking mechanisms that are integrated into the product design. The locking mechanisms allow the product to be easily attached and detached from the extendable handle, adapter or other surface. The product covered by one or more claims of this specification is provided with an adaptor that attaches via tape (or other means) to any surface The adaptor provides an attachment point if an extendable handle is not in use.. The product locking mechanisms allow the product to be easily attached and detached from the adapter, as well as placed anywhere the user decides.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

FIG. 14A is a top view of an adapter which can be affixed to a mobile device or other object according to an embodiment.

FIG. 14B is a perspective view of an adapter which can be affixed to a mobile device or other object according to an embodiment.

FIG. 14C is a side view of an adapter which can be affixed to a mobile device or other object according to an embodiment.

FIG. 14D is an exploded side view showing the adapter edge where the product container grip attaches in a locked configuration according to an embodiment.

FIG. 14E is a bottom view of an adapter which can be affixed to a mobile device or other object according to an embodiment.

Figure 1A:
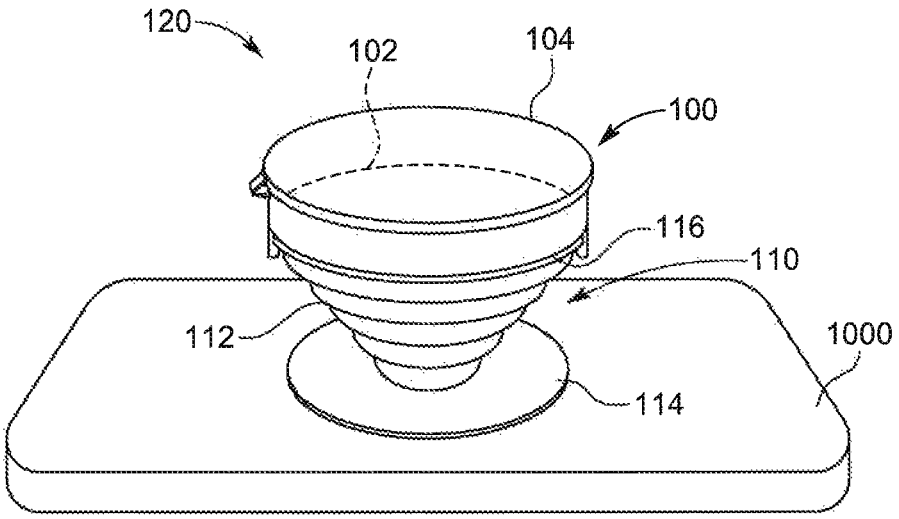
FIG. 1A is a perspective view of a mobile device and an extendable container that includes a product container grip and an extendable handle, the extendable handle shown in an extended configuration, according to an embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. The exemplary embodiments described herein, however, are not intended to be limited to the particular forms disclosed. Rather, the instant disclosure covers all modifications, equivalents, and alternatives falling within the scope of the appended claims.

SUMMARY OF THE INVENTION

The present invention provides a product container grip comprising a container wall forming a cavity, a container top portion releasably attached to said container wall, a container bottom portion integral with said container wall, a locking mechanism disposed at least in part in said container wall. The locking mechanism provides a means for releasably attaching said container onto an extendable handle. Also provided is a container having a bottom or side locking mechanism for locking onto an extendable handle or attaching onto an adapter fitted with receiving structures for accepting and forming a seal with the container.

The product container grips of the present invention comprises locking mechanisms for attachment to an extendable handle that comprise a: spring arm catch, thread, slide-on , perimeter bead, hook and snap, biased catch protrusions and apertures which fit each other in a male-female arrangement.

DETAILED DESCRIPTION OF EXEMPLARY EMBODIMENTS

The present disclosure is generally directed to product containers that can be integrated with mobile device accessories, cameras, gaming devices and many other products carried by consumers which have suitable surfaces, such as cases, bags, laptops, tablets, and the like, such as extendable handles. Examples of such extendable handles known in the art are the well-known PopSocket®, SpinPop® or Popgrip® products, although many types of extendable handles can be used in connection with the present invention. Many people carry their mobile device with them throughout the day. Various accessories for mobile devices are available, including extendable handles that have a disc shaped component that a user holds to facilitate handling of the mobile device.

Disclosed herein are product container grips that can attach with various extendable handles. The product container grips may contain any suitable product, such as a cosmetic product (e.g., lip balm, lip gloss, blush, dental floss, etc.). The product may be of any suitable form, such as gel, powder, solid, and can further comprise such items as a Bottle Opener, Flashlight/Reflector Colored lights, Speaker, Microphone, Cosmetics: Eyeshadow, Face Paint, Hair Dye, Cosmetic Powder, Sunscreen, Container for Medicinal Pills, Container for Mints/Candy, Container for Dental Floss, Contact Lens case, Thermometer, Compass, Memory. Stick, and Spinner/Spinning Container.

In some embodiments, the extendable handle is extendable and can extend and retract between an extendable configuration and a retracted configuration. While this description focuses on extendable handles, it should be well understood that the product container grip may attach to extendable handles that are not extendable or extended while remaining within the scope of this disclosure. See FIGS. 14A-16B.

FIGS. 1A, 1B, 2A, 2B are perspective and side views of a mobile device 1000 and a extendable container 120 that includes a product container grip 100 and an extendable handle 110, according to an embodiment. The mobile device 1000 may be any suitable type device such as a: mobile phone, tablet, gaming device, camera or any surface desired.

The extendable holder 110 may include a base 114 that is attachable to the mobile device 1000 and a wall 112 extending from the base 114. A top plate 116 may be attached to the upper portion of the wall 112.

Figure 1B:
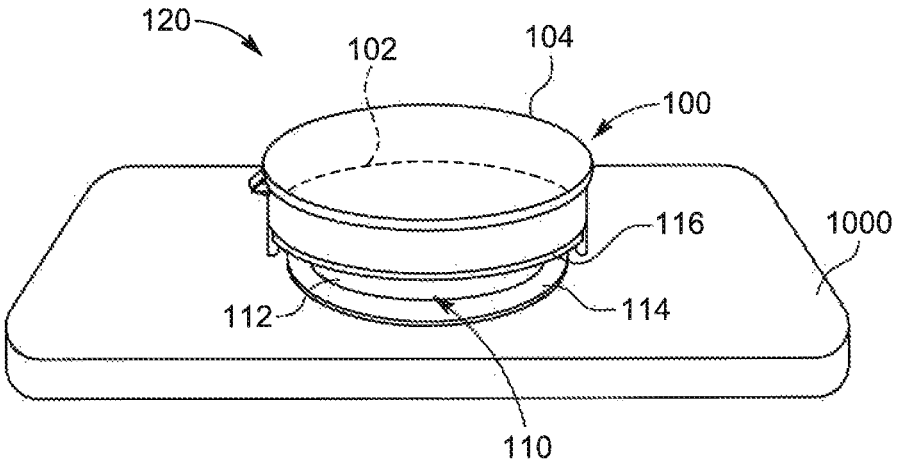
FIG. 1B is a perspective view of the mobile device and the extendable container of FIG. 1A, the extendable handle shown in a retracted configuration, according to an embodiment.
Figure 2A:
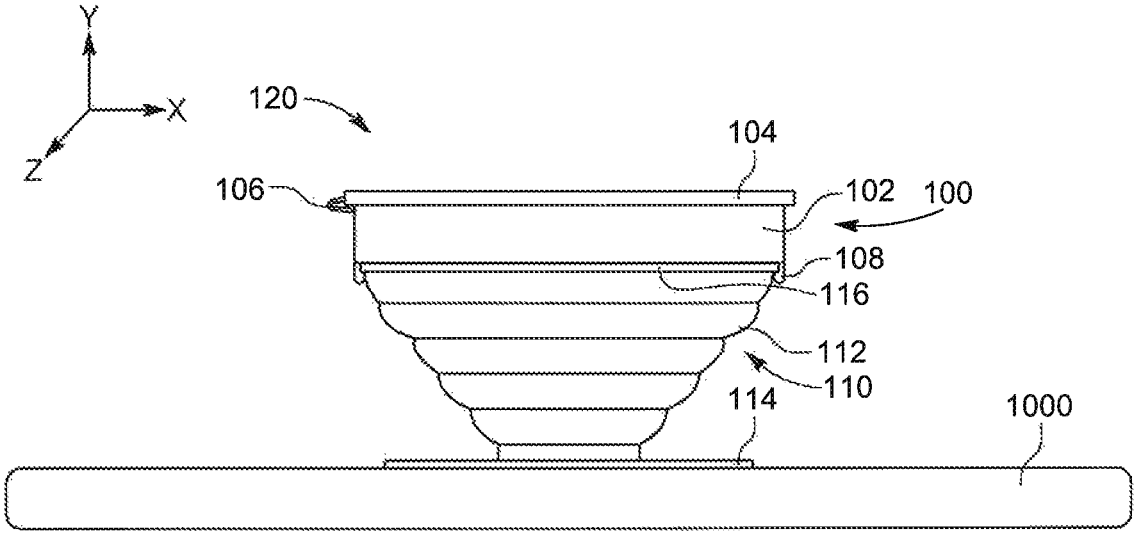
FIG. 2A is a side view of the mobile device and the extendable container of FIG. 1A, the extendable handle in an extended configuration, according to an embodiment.
Figure 2B:
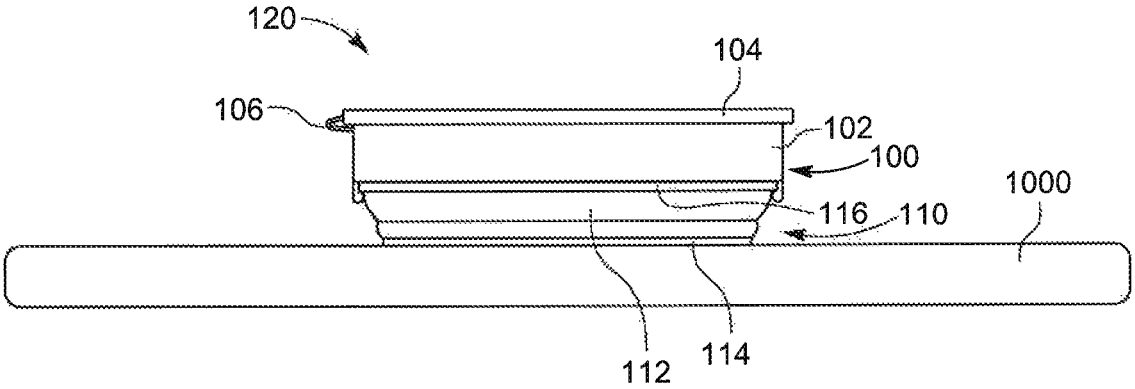
FIG. 2B is a side view of the mobile device and the extendable container of FIG. 1A, the extendable handle in a retracted configuration, according to an embodiment.

The extendable holder 110 may be configurable between an extended configuration (FIGS. 1A, 2A) and a retracted configuration (FIGS. 1B, 2B). In some embodiments, the wall 112 extends and retracts between the extended configuration and the retracted configuration. The wall 112 may extend and retract by any suitable mechanism. In some embodiments, the wall 112 extends and retracts in an accordion like manner. In other embodiments, the wall 112 may extend and retract in a twisting, springing or otherwise rotating manner.

The product container grip 100 may comprise a bottom portion 102 and a top portion 104. At least one of the: bottom portion 102 or top portion 104 includes at least one cavity 150 (FIG. 3B) for containing product. While FIGS. 1A-9E show embodiments in which the at least one cavity 150 is provided in the bottom portion 102, in other embodiments, at least one cavity may be provided in the top portion 104, in addition to or instead of in the bottom portion 102.

The product container grip 100 attaches to the extendable handle 110 by way of a locking mechanism 108. The locking mechanism 108 attaches the product container grip 100 to the extendable handle 110. The locking mechanism 108 is configured to maintain the product container grip 100 in position on the extendable handle 110, throughout use and movement of the mobile device 1000. The locking mechanism 108 may be configured to maintain the product container grip 100 in position on the extendable handle 110, even when turned up-side-down, bumped, suddenly moved, etc. In other words, the locking mechanism 108 attaches the product container grip 100 to the extendable handle 110, in order to prevent unintended disengagement thereof. In some embodiments, the locking mechanism 108 restricts lateral movement of the product container grip 100 relative to the mobile device 1000 in all three directions (x, y, z directions) (see FIG. 2A). Thus, when the extendable container 120 is attached to the mobile device 1000, the product container grip 100 remains attached to the mobile device 1000 throughout everyday carrying and usage of the mobile device. In some embodiments, the locking mechanism 108 restricts rotational movement of the product container grip 100 (e.g., prevents the product container grip from spinning about its y-axis). In other embodiments, the locking mechanism 108 allows rotational movement of the product container grip 100 (e.g., allows the product container grip to spin about its y-axis).

The locking mechanism 108 may comprise any suitable type of configuration for attaching the product container grip 100 to the extendable handle 110. FIGS. 2A-3D show an embodiment in which the locking mechanism 108 comprises biased catches 108. The product container grip 100 may include any suitable number of biased catches 108, e.g., two, three, four, five, etc. Each biased catch 108 may include a catch 132 that is biased in a locked configuration. In some embodiments, when the product container grip 100 is attached to the extendable handle 110, the catch 132 will be in its locked configuration and will prevent movement of the product container grip 100 relative to the extendable handle 110.

Figure 3A:
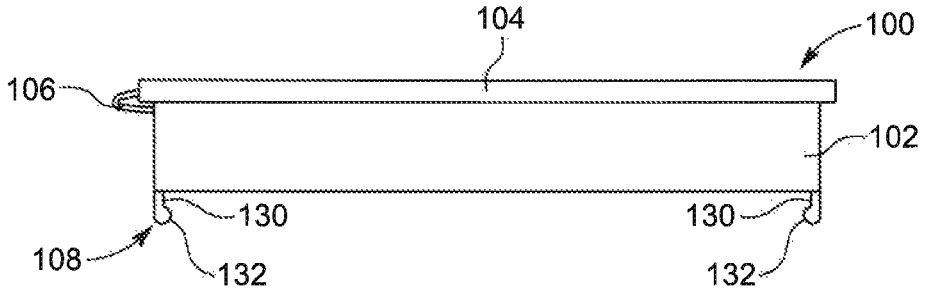
FIGS. 3A and 3B are side and perspective views of the product container grip of FIG. 1A, according to an embodiment.
Figure 3B:
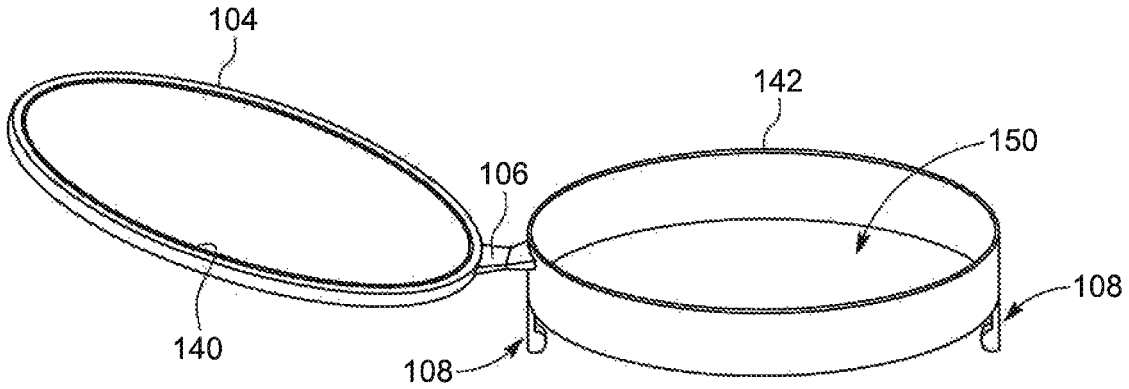
Figure 3C:
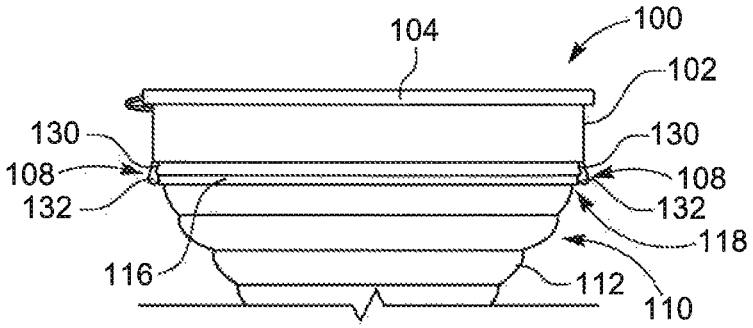
FIG. 3C is a side view of the product container grip as it is being attached to the extendable handle of FIG. 1A, according to an embodiment.
Figure 3D:
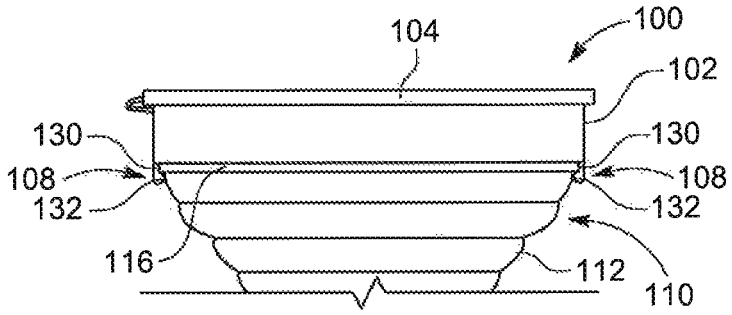
FIG. 3D is a side view of the product container grip attached to the extendable handle of FIG. 1A, according to an embodiment.

FIGS. 3A and 313 are side and perspective views of the product container grip 100, including the top portion 104 and bottom portion 102. FIG. 3C is a side view of the product container grip 100 as it is being attached to the extendable handle 110. FIG. 3D is a side view of the product container grip 100 attached to the extendable handle 110.

In the embodiment shown in FIGS. 3A-3D, the extendable handle 110 includes a top plate 116 that has a larger periphery (e.g., circumference) than the top portion of the wall 112, thus providing a space 118 (FIG. 3C) beneath the top plate 116 and radially outside of the wall 112. The biased catch 108 may be configured such that in the locked configuration, each catch 132 is disposed in the space 118 and beneath the top plate 116. Each catch 108 may include an arm 130 extending from the product container grip 100 (e.g., from the bottom portion 102 of the product container grip 100) to the catch 132. Thus, in the locked configuration, the bottom portion 102, arms 130, and catches 132 hold the bottom portion 102 in place on the extendable handle top plate 116. In some embodiments, in the locked configuration, each arm 130 abuts the peripheral edge of the top plate 116, each catch 132 abuts a respective bottom portion of the top plate 116, and the bottom portion 102 abuts the top surface of the top plate 116. In some embodiments, the catch 132, arm 130, and bottom portion 102 are configured to pinch the respective portion of the extendable handle top plate 116.

The biased catch 108 may be configured to facilitate user friendly attachment of the product container grip 100 to the extendable handle 110. For example, in the embodiment shown in FIGS. 3A-3D, the catch 132 has a rounded bottom portion. When the catch 108 fits over the top plate 116, the peripheral edge of the top plate 116 pushes the catch 132 outwards and away from its biased configuration. As the catch 132 is pushed outwards, the rounded bottom portion of the catch 132 facilitates the catch 132 in sliding across the peripheral edge of the top plate 116. Once the catch 132 has slid across the top plate 116, the catch 132 returns to its biased, locked configuration within space 118.

The catch 132 may be biased in the locked configurations through any suitable means, e.g., a resilient member, spring, and other mechanisms known in the art for biasing catches. In the embodiment shown in FIGS. 3A-3D, the arm 130 is configured to bias the catch 132 in the locked configuration. For example, the arm 130 may be bendable in a radially outward direction and resiliently biased in the locked configuration. Thus, when the catch 132 pushes against the top plate 116, the arm 130 bends outwards so the catch 132 slides over the peripheral edge of the top plate 116 (FIG. 3C). Once the catch 132 slides across the peripheral edge of the top plate 116 and no longer pushes against it, then the arm 130 returns to its biased configuration (FIG. 3D), thus locking the product container grip 100 onto the extendable handle 110.

In some embodiments, the biased catches 108 may be configured to facilitate a user in disengaging the product container grip 100 from the extendable handle 110. For example, the upper portion of the catch 132 may be rounded, to allow the catch 132 to slide over the peripheral edge of the top plate 116 when a user firmly pulls on the product container grip 100. Thus, the biased catches 108 may be configured to allow a user to remove or replace the product container grip 100 from the extendable handle 110 while preventing unintended disengagement.

The top portion 104 may engage with the bottom portion 102 (e.g., to serve as a lid) through any suitable means. In some embodiments, the top portion 104 attaches to the bottom portion 102 through a friction fit. For example, as shown in FIG. 3B, the bottom wall of the top portion 104 may include a groove 140 that corresponds to the upper rim 142 of the bottom portion 102. The groove 140 may match the shape of the upper rim 142. Thus, when a user presses the top portion 104 onto the bottom portion, the groove 140 receives the upper rim 142 in a friction fit engagement. In some embodiments, the top portion 104 attaches to the bottom portion 102 through a snap tit engagement. For example, at least one of the top portion 104 or bottom portion 102 may have a portion (e.g., a rim) that is biased in a closed position. When a user presses the top portion 104 onto the bottom portion, the portion may snap into a closed position to maintain the top portion 104 on the bottom portion 102.

In some embodiments, the product container grip 100 includes a hinge 106 (e.g., a living hinge) that attaches the top portion 104 to the bottom portion 102. While FIGS. 1A-3D show the product container grip 100 including a hinge 106, in other embodiments, the product container grip 100 does not include a hinge.

In some embodiments, the top portion 104 and bottom portion 102 are engageable with one another through a threaded engagement. For example, the top portion 104 may have a downwardly extending rim that has a first threaded portion on its surface. The bottom portion 102 may have a corresponding second threaded portion on an upper portion of its outer or inner surface. The first threaded portion and second threaded portion may be configured to engage and disengage by threading onto one another to attach or remove the top portion 104 on or from the bottom portion 102, and thus close or open the container 100. In some embodiments, a leash member extends from the top portion 104 to the bottom portion 102 to prevent the top portion 104 from getting displaced when the container 100 is open.

Referring now to FIGS. 4A-9E, in some embodiments, a product container grip may be configured to attach to a extendable handle without engaging a top plate. For example, the extendable handle may not have a top plate or the top plate may be removed from the extendable handle wall prior to attaching the product container grip. In such embodiments, for example, the product container grip may attach to the wall of the extendable handle.

Some of the details described above with reference to FIGS. 1A-3D also apply to FIGS. 4A-9E, and to avoid repetition, such details will not be repeated.

FIGS. 4A, 4B, 5A, 5B are perspective and side views of a mobile device 4000 and an extendable container 420 that includes a product container grip 400 and an extendable handle 410, according to an embodiment. The mobile device 4000 may be any suitable type device such as a: mobile phone, tablet, laptop, bags, gaming device, camera or any surface desired etc.

The extendable handle 410 may include a base 414 attachable to the mobile device 4000 and a wall 412 extending from the base 414.

Figure 4A:
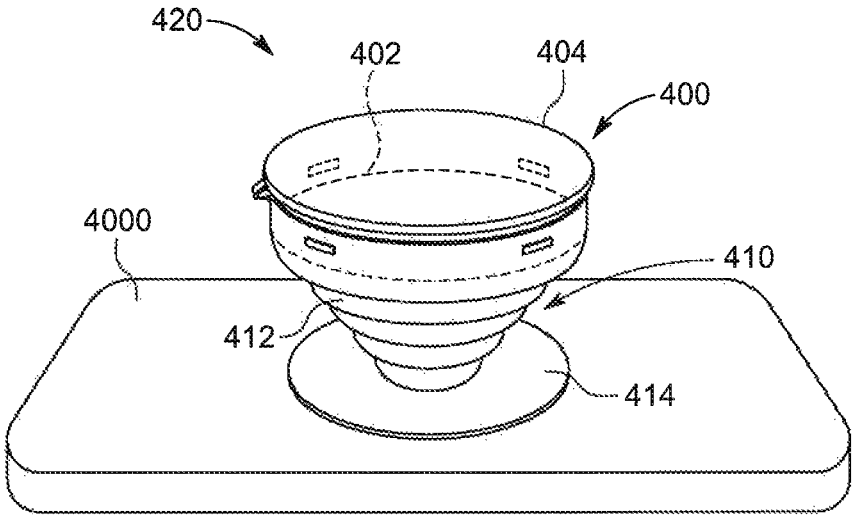
FIG. 4A is a perspective view of a mobile device and the extendable container that includes a product container grip and an extendable handle, the extendable handle shown in an extended configuration, according to an embodiment.
Figure 4B:
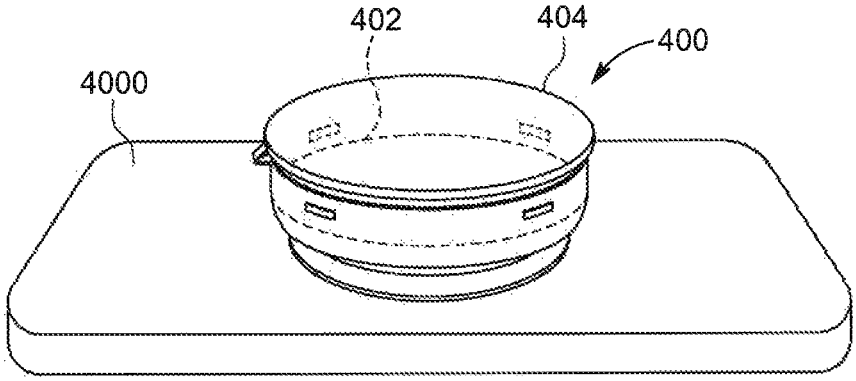
FIG. 4B is a perspective view of the mobile device and the extendable container of FIG. 4A, the extendable handle shown in a retracted configuration, according to an embodiment.
Figure 5A:
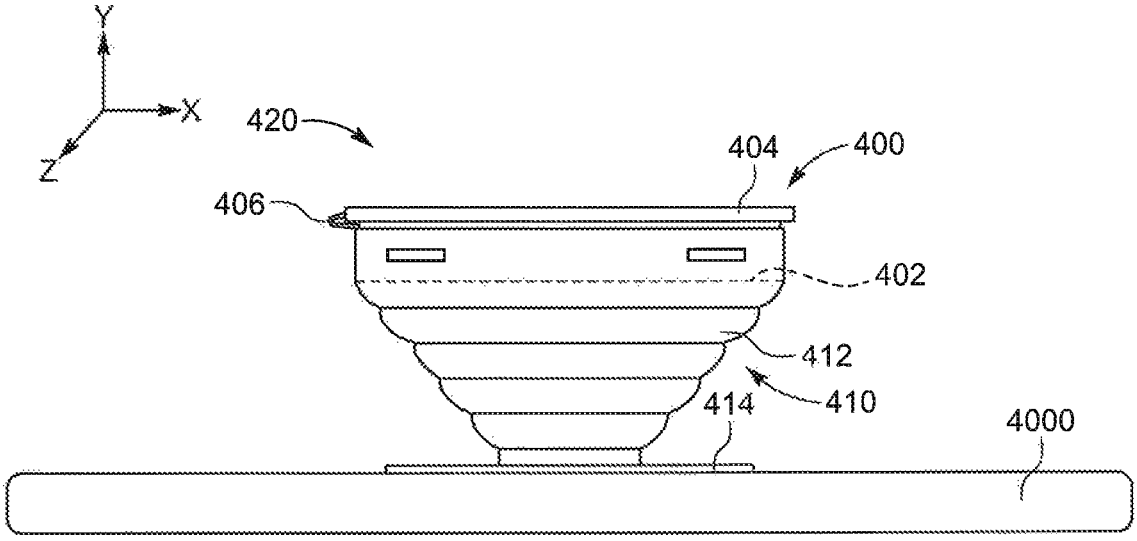
FIG. 5A is a side view of the mobile device and the extendable container of FIG. 4A, the extendable handle in an extended configuration, according to an embodiment.
Figure 5B:
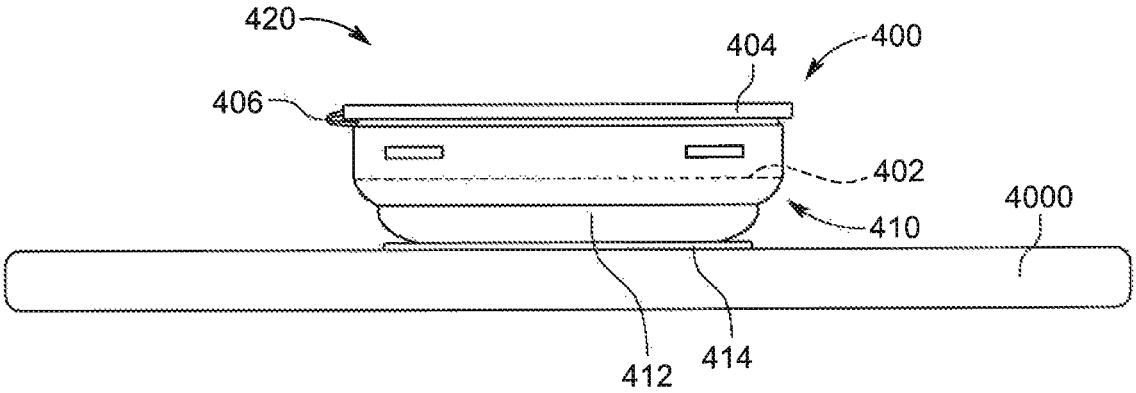
FIG. 5B is a side view of the mobile device and the product container grip of FIG. 4A, the extendable handle in a retracted configuration, according to an embodiment.

The extendable handle 410 may be configurable between an extended configuration (FIGS. 4A, 5A) and a retracted configuration (FIGS. 4B, 5B. In some embodiments, the wall 412 extends and retracts between the extended configuration (FIGS. 4A, 5A) and the retracted configuration (FIGS. 4B, 5B. The wall 412 may extend and retract by any suitable mechanism, e.g., accordion, rotating, twisting, springing, etc.

The product container grip 400 comprises a bottom portion 402 and a top portion 404. At least one of the bottom portion 402 or top portion 404 includes at least one cavity 450 (FIG. 7A) for containing product. While FIGS. 1A-9E show embodiments in which at least one cavity 450 is provided in the bottom portion 402, in other embodiments, at least one cavity may be provided in the top portion 404, in addition to or instead of in the bottom portion 402. The product container grip may have multiple cavities in a split container style, or be divided into top and bottom levels.

Figure 6:
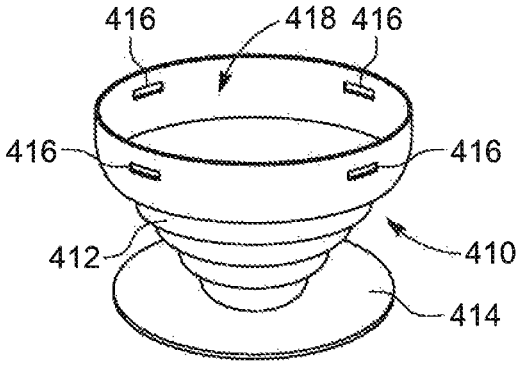
FIG. 6 is a perspective view of the extendable handle of FIG. 1A, in an extended configuration, according to an embodiment.

FIG. 6 shows an embodiment of an extendable handle 410 that includes a plurality of apertures 416 extending through the wall 412. The wall 412 of the extendable handle 410 defines a cavity 418.

Figure 7A:
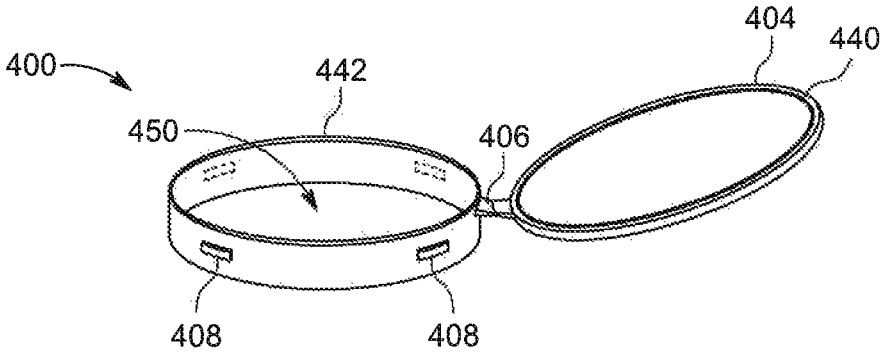
FIGS. 7A and 7B are perspective views of the product container grip of FIG. 4A, according to an embodiment.
Figure 7B:
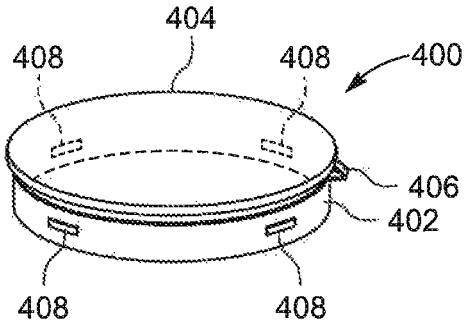
Figure 7C:
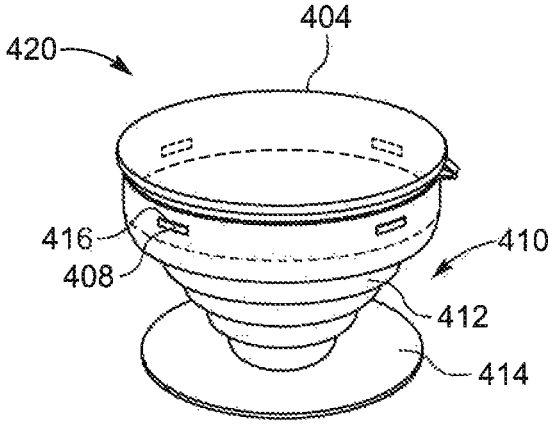
FIGS. 7C and 7D are perspective views of the extendable container of FIG. 4A, according to an embodiment.
Figure 7D:
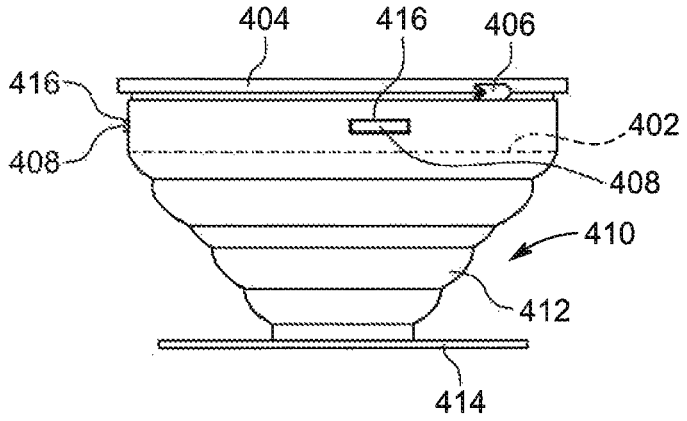

FIGS. 7A and 7B are perspective views of the product container grip 400, including the top portion 404 and bottom portion 402. FIGS. 7C and 7D are perspective and side views of the product container grip 400 attached to the extendable handle 410. The product container grip 400 may be configured to fit within the cavity 418. In some embodiments, the product container grip 400 fits snugly within the cavity 418 such that the inner surface of the wall 412 abuts the outer peripheral surface of the product container grip 400.

Referring to FIGS. 6-7D, the product container grip 400 may attach to the extendable handle 410 by way of a locking mechanism 408. The locking mechanism 408 attaches the product container grip 400 to the extendable handle 410 and is configured to maintain the product container grip 400 in position on the extendable handle 410, throughout use and movement of the device. The locking mechanism 408 may be configured to maintain the product container grip 400 in position on the extendable handle 410, even when turned up-side-down, bumped, suddenly moved, etc. In other words, the locking mechanism 408 attaches the product container grip 400 to the grip 410, in order to prevent unintended disengagement thereof. In some embodiments, the locking mechanism 408 restricts lateral movement of the product container grip 400 relative to the mobile device 4000 in all three directions (x, y, z directions) (see FIG. 5A). Thus, when the extendable container 420 is attached to the mobile device 4000, the product container grip 400 remains attached to the mobile device 4000 throughout everyday carrying and usage of the mobile device. In some embodiments, the locking mechanism 408 restricts rotational movement of the product container grip 400 (e.g., prevents the product container grip from spinning about its y-axis). In other embodiments, the locking mechanism 408 allows rotations movement of the product container grip 400 (e.g., allows the product container grip to spin about its y-axis).

The locking mechanism 408 may comprise any suitable type of configuration for attaching the product container grip 400 to the grip 410. FIGS. 7A-7D show an embodiment in which the locking mechanism 408 comprises projections 408 that are configured to fit within the apertures 416 of extendable handle to provide a male-female locking arrangement. The product container grip 400 may include any suitable number of protrusions 408, e.g., two, three, four, five, etc. The protrusions 408 may each extend radially outward from the wall 412. In some embodiments, when the product container grip 400 is disposed within the cavity 418 and attached to the extendable handle 410, the protrusions 408 will each extend through the respective apertures 416 to prevent movement of the product container grip 400 relative to the extendable handle 410.

At least one of the wall 412 or the apertures 408 may be flexible, so that a user can push the product container grip 400 downward into the cavity 418. As the product container grip 400 is pushed down to where the protrusions 408 align with the apertures 416, the protrusions extend through the apertures 416 to lock the product container grip 400 in place within the cavity 418.

The top portion 404 may engage with the bottom portion 402 (e.g., to serve as a lid) through any suitable means. In some embodiments, the top portion 404 attaches to the bottom. portion 402 through a friction fit. For example, as shown in FIG. 7A, the bottom wall of the top portion 404 may include a groove 440 that corresponds to the upper rim 442 of the bottom portion 402. The groove 440 may match the shape of the upper rim 442. Thus, when a user presses the top portion 404 onto the bottom portion 402, the groove 440 receives the upper rim 442 in a friction fit engagement. In some embodiments, the top portion 404 attaches to the bottom portion 402 through a snap fit engagement. For example, at least one of the top portion 404 or bottom portion 402 may have a portion (e.g., a rim) that is biased in a closed position. When a user presses the top portion 404 onto the bottom portion, the portion may snap into a closed position to maintain the top portion 104 on the bottom portion 402.

In some embodiments, the product container grip 400 includes a hinge 406 (e.g., a living hinge. Some of the hinges that are useful in connection with the invention are one or more of the following: butt hinge, barrel hinge, piano hinges, butterfly hinges, flush hinges, pivot hinges, barrel hinge and spring hinge: that attaches the top portion 404 to the bottom portion 402. While FIGS, 4A-7D show the product container grip 400 including a hinge 406, in other embodiments, the product container grip 400 does not include a hinge.

In some embodiments, the top portion 404 and bottom portion 402 are engageable with one another through a threaded engagement. For example, the top portion 404 may have a downwardly extending rim that has a first threaded portion on its surface. The bottom portion 402 may have a corresponding second threaded portion on an upper portion of its outer or inner surface. The first threaded portion and second threaded portion may be configured to threadedly engage and disengage with one another to attach or remove the top portion 404 on or from the bottom portion 402, and thus close or open the product container grip 400, which is also the case for similar embodiments described herein and shown in the figures. In some embodiments, a leash member 106 extends from the top portion 404 to the bottom portion 402 to prevent the top portion 404 from getting displaced when the container 400 is open.

Figure 8:
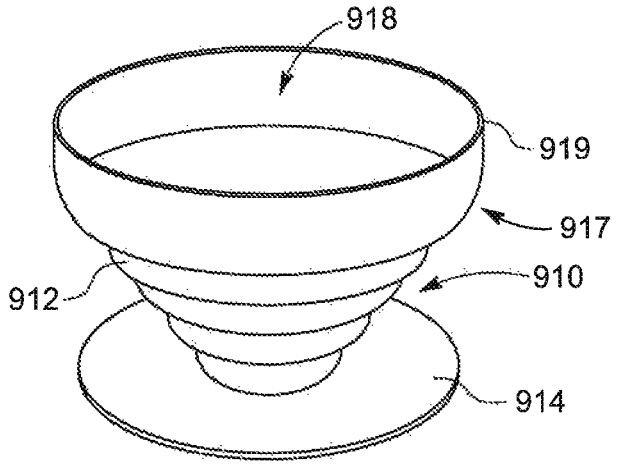
FIG. 8 is a perspective view of the extendable handle of FIG. 4A, according to an embodiment.
Figure 9A:
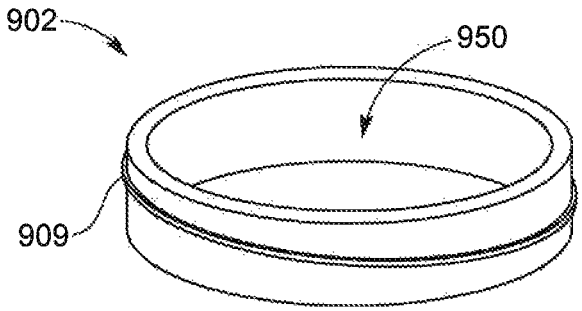
FIG. 9A is a perspective view of a top portion of the product container grip of FIG. 4A, according to an embodiment.
Figure 9B:
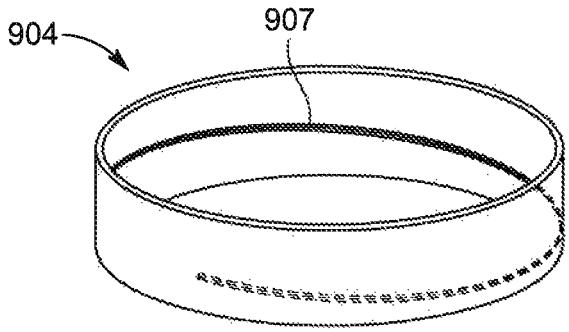
FIG. 9B is a perspective view of a bottom portion of the product container grip of FIG. 4A, according to an embodiment.
Figure 9C:
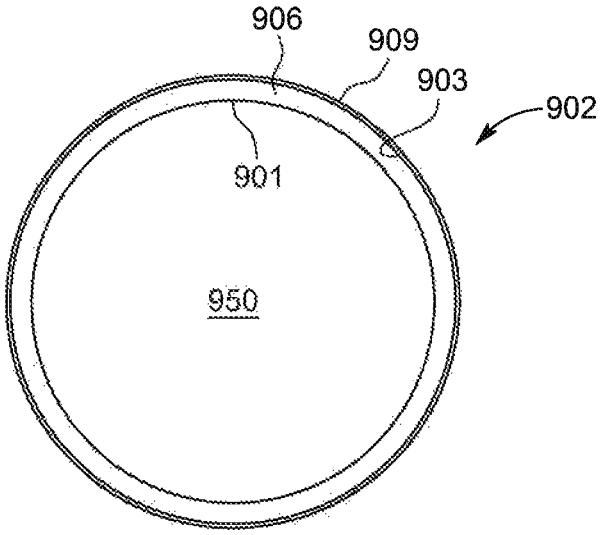
FIG. 9C is a top view of the bottom portion of the product container grip of FIG. 4A, according to an embodiment.
Figure 9D:
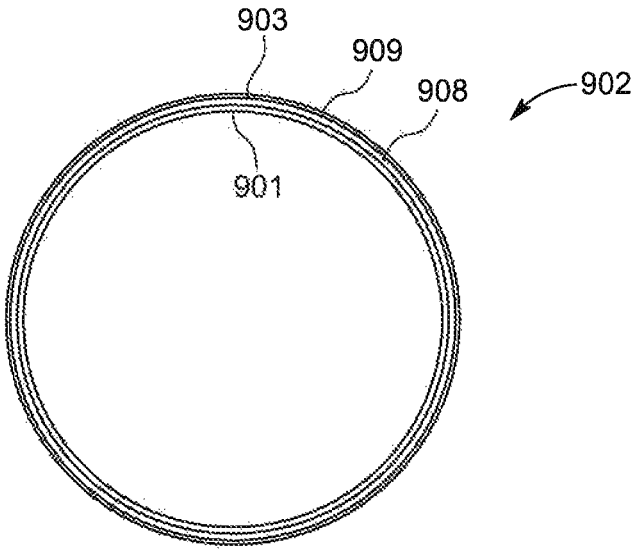
FIG. 9D is a bottom view of the bottom portion of the product container grip of FIG. 4A, according to an embodiment.
Figure 9E:
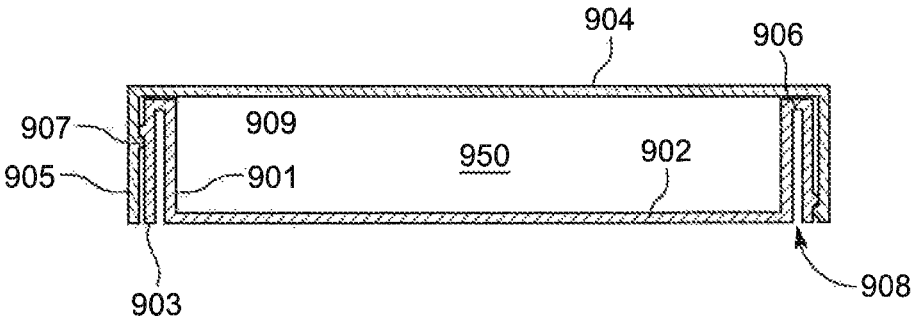
FIG. 9E is a cross-sectional view of the product container grip of FIG. 4A, according to an embodiment.

FIGS. 8-9E show an embodiment of a product container grip 900 that attaches within the cavity 918 of the extendable handle 910. The extendable handle 910 may or may not have apertures within the wall 912. The extendable handle 910 may include a base 914 attachable to a device or product (e.g., 1000, 4000) and a wall 912 extending from the base 914 to a top edge 919 that extends around the top periphery of the wall 912.

The extendable handle 910 may be configurable between an extended configuration and a retracted configuration. In some embodiments, the wall 912 extends and retracts between the extended configuration and the retracted configuration. The wall 912 may extend and retract by any suitable mechanism, as described above with reference to FIGS. 1A-2B.

The product container grip 900 comprises a bottom portion 902 and a top portion 904. At least one of the bottom portion 902 or top portion 904 includes at least one cavity 950 (FIG. 9A) for containing product. While FIGS. 9A-9E show embodiments in which at least one cavity is provided in the bottom portion 902, in other embodiments, at least one cavity may be provided in the top portion 904, in addition to or instead of in the bottom portion 902.

The product container grip 900 may be configured to fit within the cavity 918. In some embodiments, the product container grip 900 fits snugly within the cavity 918 such that the inner surface of the wall 912 abuts the outer peripheral surface of the bottom portion 902 of the product container grip 900.

The product container grip 900 may attach to the extendable handle 910 by way of a locking mechanism 908. The locking mechanism 908 attaches the product container grip 900 to the extendable handle 910 and is configured to maintain the product container grip 900 in position on the extendable handle 910 throughout use and movement of the device or product as described above with reference to FIGS. 1A-7D.

In the embodiment shown in FIGS. 9A-9E, the locking mechanism 908 comprises a pocket 908 for receiving an upper portion 917 of the wall 912 and engaging therewith through a friction fit. In some embodiments, the embodiment shown in FIGS. 9A-9E may have a locking mechanism for engaging with apertures within the wall 912, for example, protrusions (e.g., 408) configured to protrude through apertures (e.g., 416) as shown in FIGS. 5A-7D.

Figure 9F:
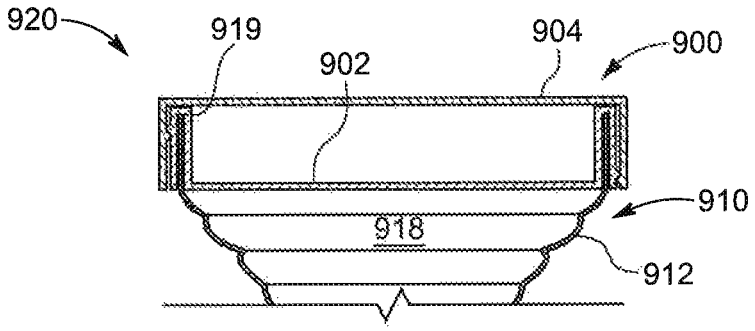
FIG. 9F is a cross-sectional view of the product container grip attached to the extendable handle of FIG. 4A, according to an embodiment.

The bottom portion 902 may comprise a double walled rim that includes an inner wall 901, an outer wall 903, and a rim wall 906 extending there between. The rim wall 906 may extend from the top of the inner wall 901 to the top of the outer wall 903. The rim wall 906 may be substantially perpendicular to the inner wall 901 and the outer wall 903. The outer surface of the inner wall 901, inner surface of the outer wall 903, and bottom surface of the rim wall 906 may define the pocket 908. The pocket 908 is sized and configured to correspond to the upper portion 917 of the wall 912. For example, as shown in FIG. 9F, when the product container grip 900 is disposed within the cavity 918, the upper portion 917 of the wall 912 fits within the pocket 908, so that upper rim 919 abuts the bottom edge of rim wall 906, the outer surface of the inner wall 901 abuts the inner surface of the wall 912, and the inner surface of the outer wall 903 abuts the outer surface of the wall 912.

The top portion 904 may comprise a rim 905 that extends around the periphery of the top portion 904 and is configured to engage with the outer wall 903 of the bottom portion 902. The top portion 904 may attach to the bottom portion 902 through any suitable means. In the embodiment shown in FIGS. 9A-9E, the top portion 904 and bottom portion 902 attach to one another through a threaded engagement. As shown in FIG. 9E, the outer surface of the outer wall 903 may have a first threaded component 909 and the inner surface of the top portion rim 905 may have a second threaded component 907; the first and second threaded components 909, 907 may threadedly engage with one another to fasten the top portion 904 onto the bottom portion 902. In some embodiments, a leash member extends from the top portion 904 to the bottom portion 902 to prevent the top portion 904 from getting displaced when the container 900 is open.

In some embodiment, the pocket 908 is configured to pinch the upper portion 917 of the wall 912. For example, the outer wall 903 can be biased radially inward towards the inner wall 901, to thus pinch the wall 912 between the inner wall 901 and outer wall 903. In some embodiments, when the upper portion 904 is fastened e.g., via a threaded engagement; or other means, including those discussed herein, onto the bottom portion 902, the fastening causes the outer wall 903 to bend radially inward toward the inner wall 901 and thus pinch the upper portion 917 of the wall 912.

Figure 10:
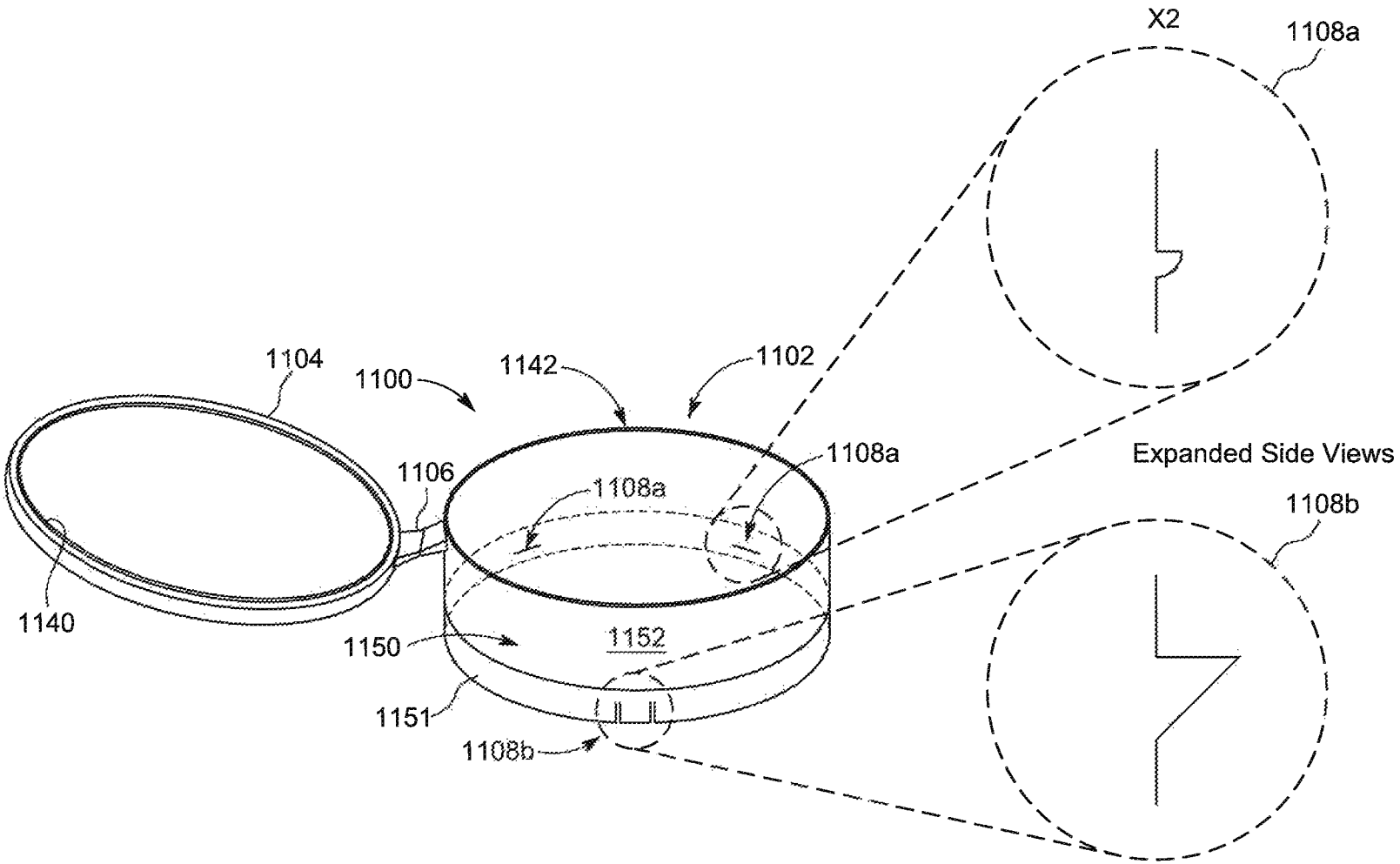
FIG. 10 is a perspective view of a product container grip, according to an embodiment.

FIG. 10 is a perspective view of a product container grip 1100, according to an embodiment. Various features of the product container grip 1100 are similar to those of the product container grip 100 described above and will not be repeated. The product container grip 1100 may include at least one first locking mechanism 1108*a* and at least one second locking mechanisms 1108*b*. While the product container 1100 may include any suitable number thereof, FIG. 10 shows an embodiment comprising two first locking mechanisms 1108*a* and one second locking mechanism 1108*b*. FIG. 10 also shows exploded views of the first and second locking mechanisms 1108*a*, 1108*b*, according to an embodiment. The first and second locking mechanisms 1108*a*, 1108*b* may be disposed on a radially extending skirt 1151 that extends downward from the bottom wall 1152 of the bottom portion 1102. The skirt 1151 may extend around substantially the entire periphery of the bottom portion 1102. For example, the skirt 1151 may extend continuously around the entire periphery of the bottom portion 1102. The skirt 1151 may be configured to slide across the peripheral edge of the extendable handles' top plate 116, similar to the sliding ability of the catch 132 as described above with reference to FIG. 3C. A user may push downward on the product container grip 1100 to cause the skirt 1151 to slide over the peripheral edge of the top plate 116. Once the product container grip 1100 is slid into place, the first locking mechanisms 1108*a* and second locking mechanism 1108*b* may engage with the top plate 116 to maintain the product container grip 1100 on the top plate 116. The first locking mechanism 1108*a* may comprise a dimple that snaps radially inward to maintain the product container grip 1100 on the top plate 116.

Figure 11A:
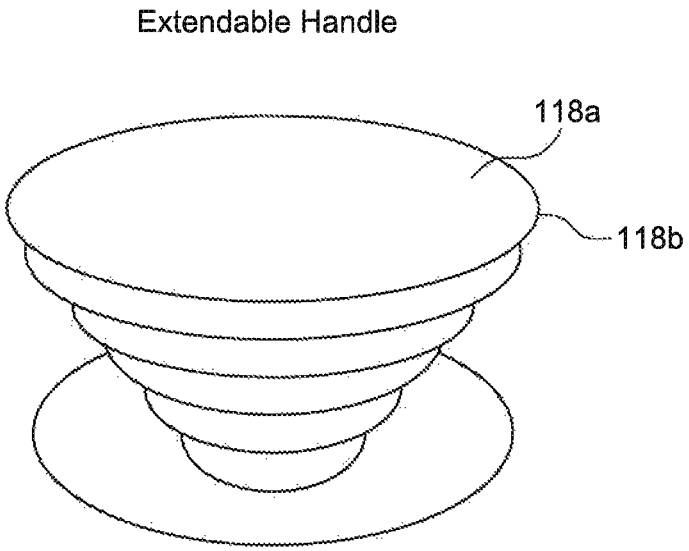
FIG. 11A is a perspective view of the extendable holder used in connection with the present invention in an extended position according to an embodiment.
Figure 11B:
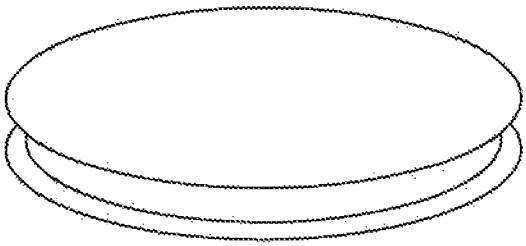
FIG. 11B is a perspective view of the extendable holder used in connection with the present invention in retracted position according to an embodiment.

FIGS. 11A and 11B shows an extendable handle 110 similar to that shown, by way of example, in FIGS. 1A and 1B except that the extendable handle of FIG. 11A further comprises a top surface 118*a* and edge or lip 118*b*.

Figure 12A:
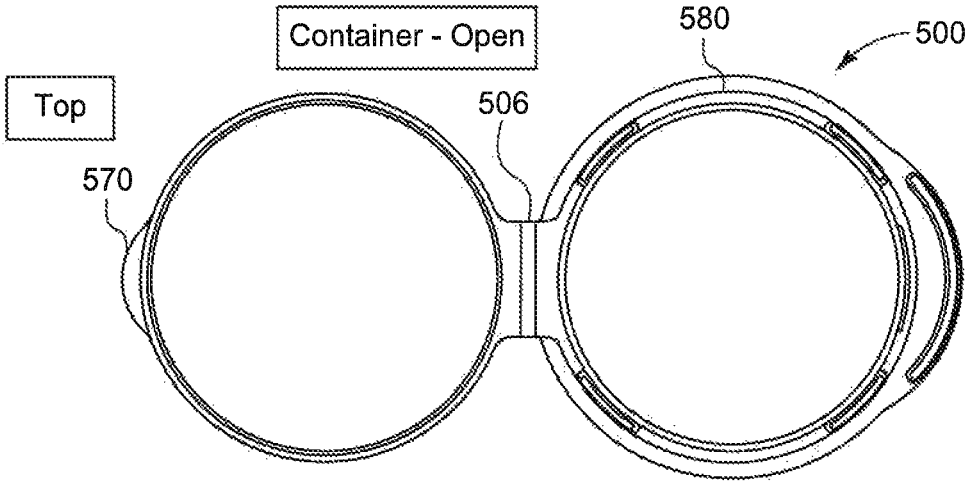
FIG. 12A is a top view of the of the product container grip in an open position according to an embodiment.
Figure 12B:
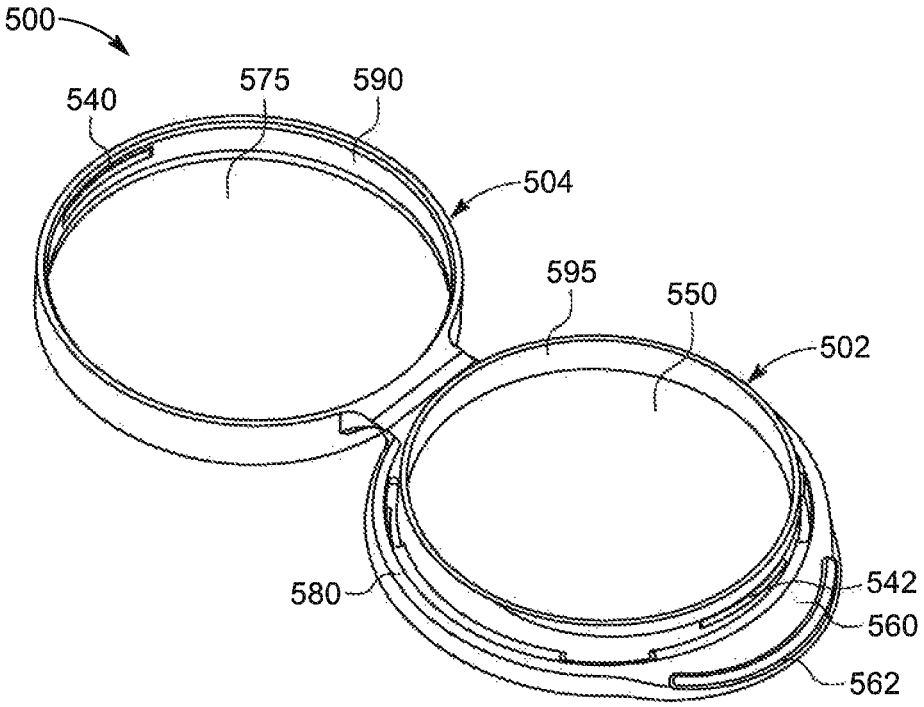
FIG. 12B is a perspective view of the product container grip in an open position according to an embodiment.
Figure 12C:
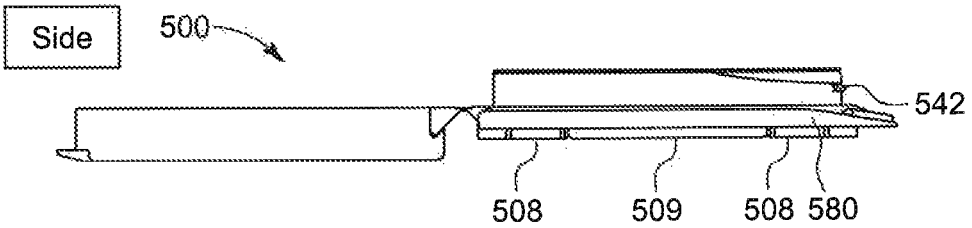
FIG. 12C is a side view of the product container grip in an open position according to an embodiment.
Figure 12D:
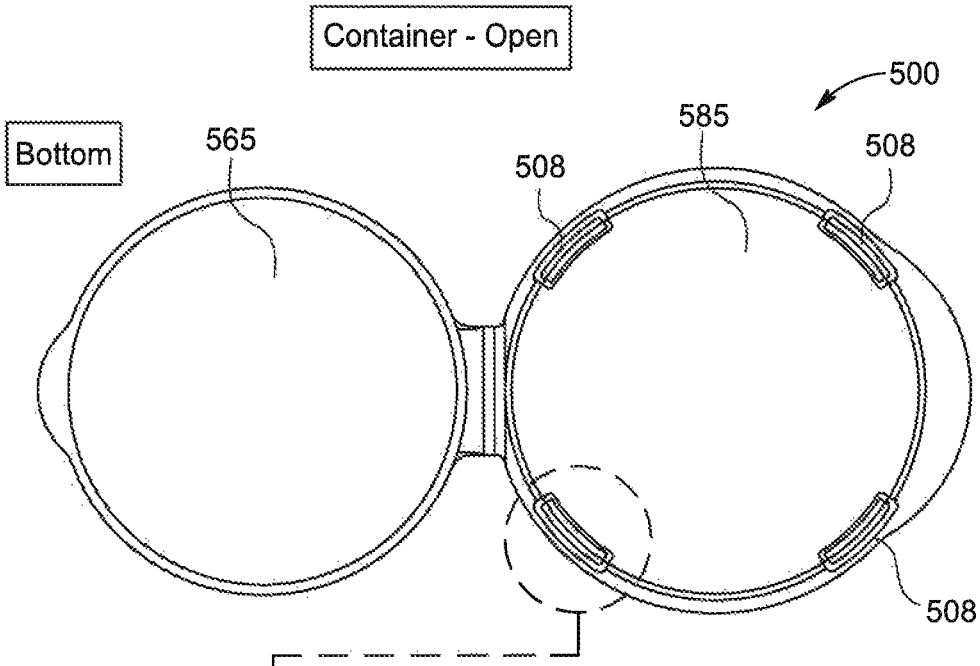
FIG. 12D is a bottom view of the product container grip in an open position according to an embodiment.
Figure 12E:
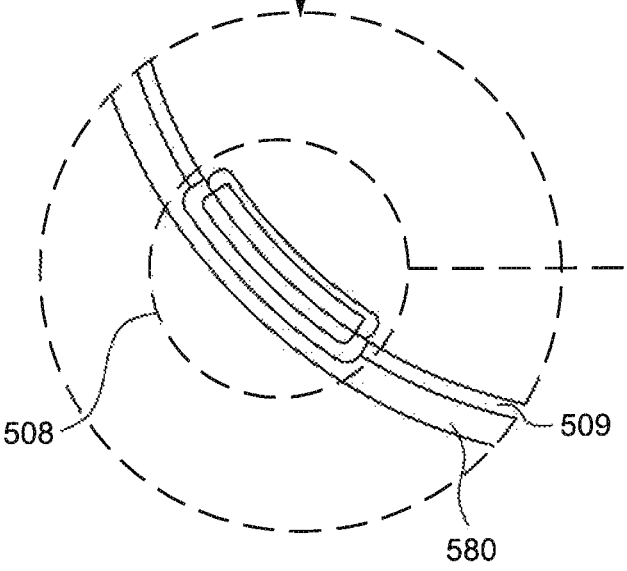
FIG. 12E is an enlarged bottom view of the product container grip in an open position depicting parts of the locking mechanism according to an embodiment.
Figure 12F:
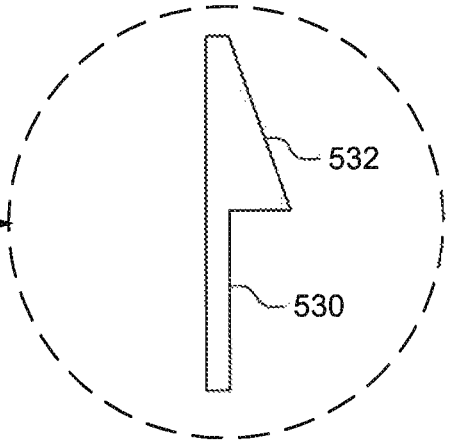
FIG. 12F is an enlarged side view of a catch used in the locking mechanism in the product container grip according to an embodiment.
Figure 12G:
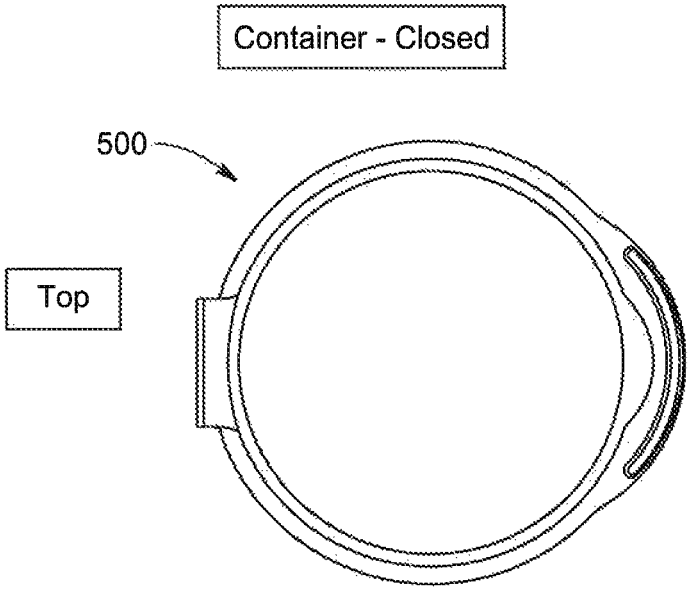
FIG. 12G is a top view of the closed product container grip according to an embodiment.
Figure 12H:
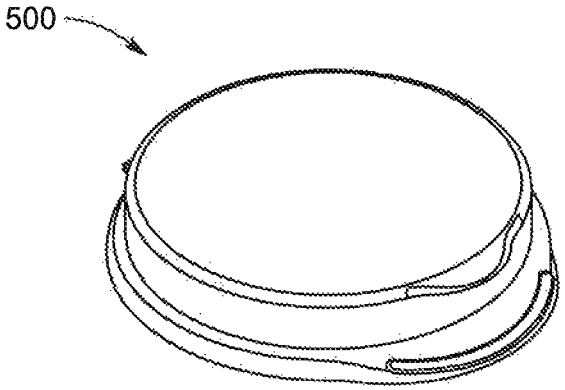
FIG. 12H is a perspective view of the closed product container grip according to an embodiment.
Figure 12I:
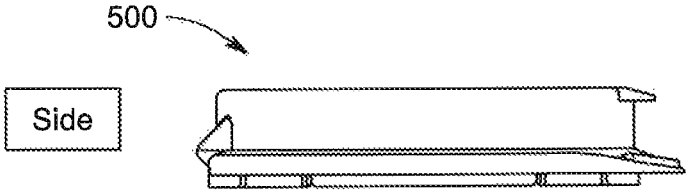
FIG. 12I is a side view of the closed product container grip according to an embodiment.
Figure 12J:
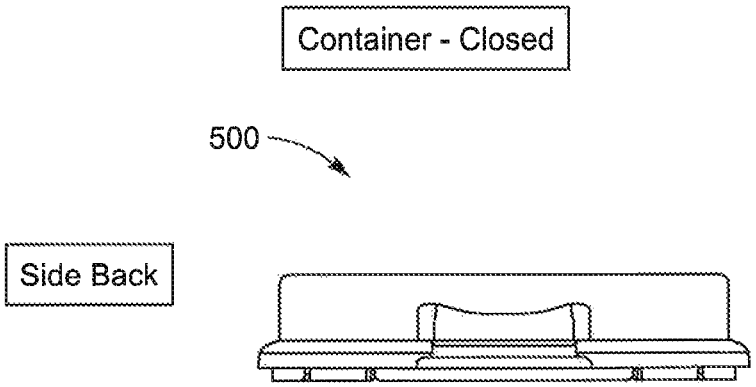
FIG. 12J is a side rear view of the closed product container grip according to an embodiment.
Figure 12K:
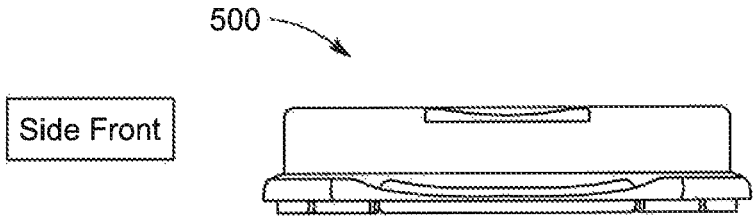
FIG. 12K is a side front view of the closed product container grip according to an embodiment.
Figure 12L:
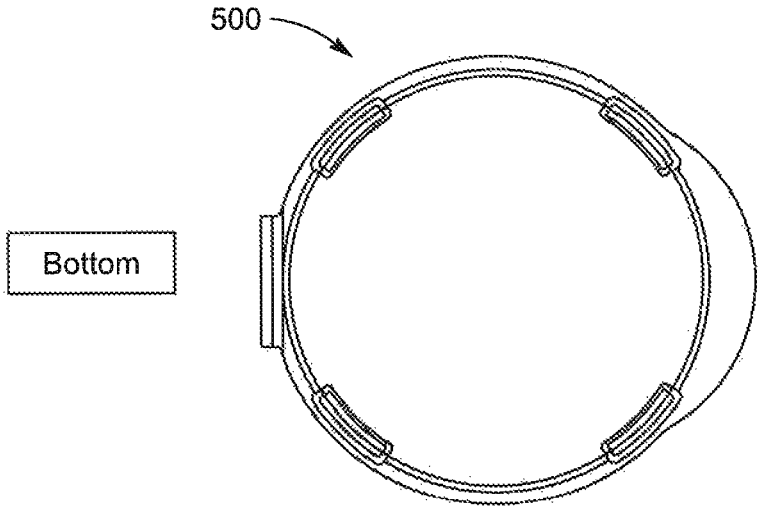
FIG. 12L is top view of the bottom of a product container grip according to an embodiment.
Figure 12M:
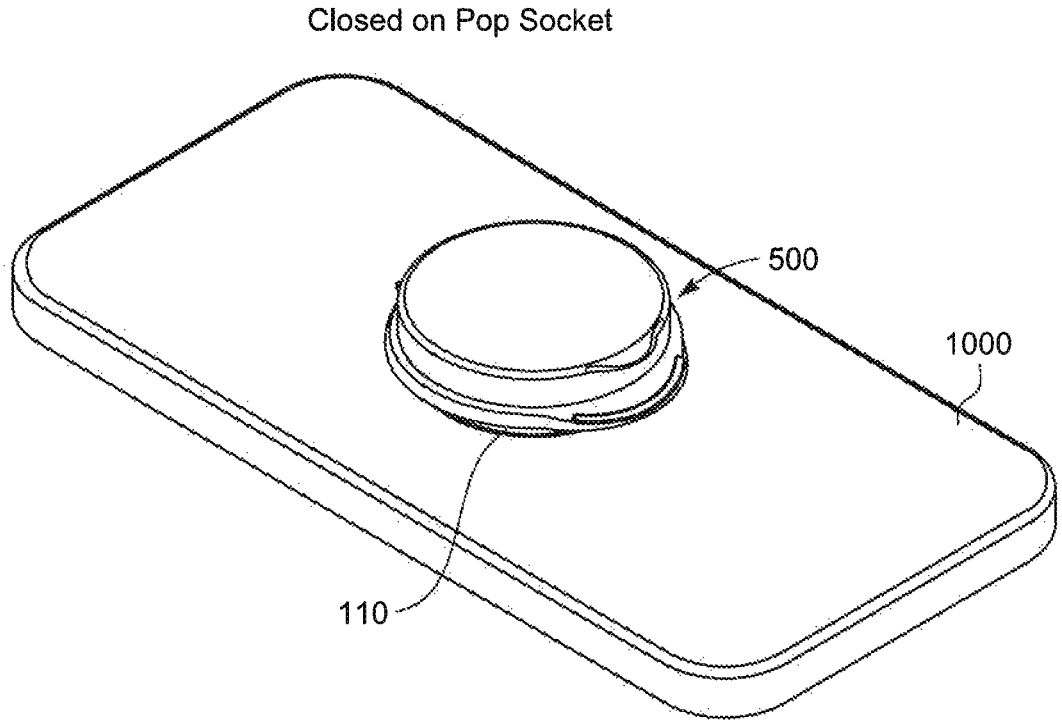
FIG. 12M is a perspective view of a product container grip in a closed position, locked on an extendable handle that is attached to a mobile device.
Figure 12N:
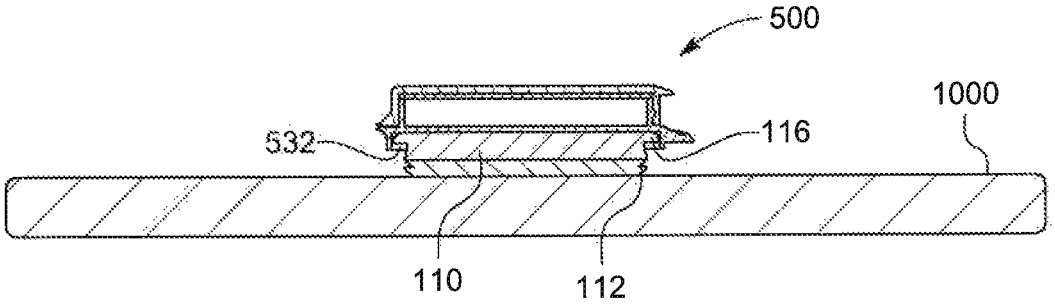
FIG. 12N is a sectional view of an embodiment of the product container grip of the present invention attached to an extendable handle which is affixed to a mobile device according to an embodiment.
Figure 13A:
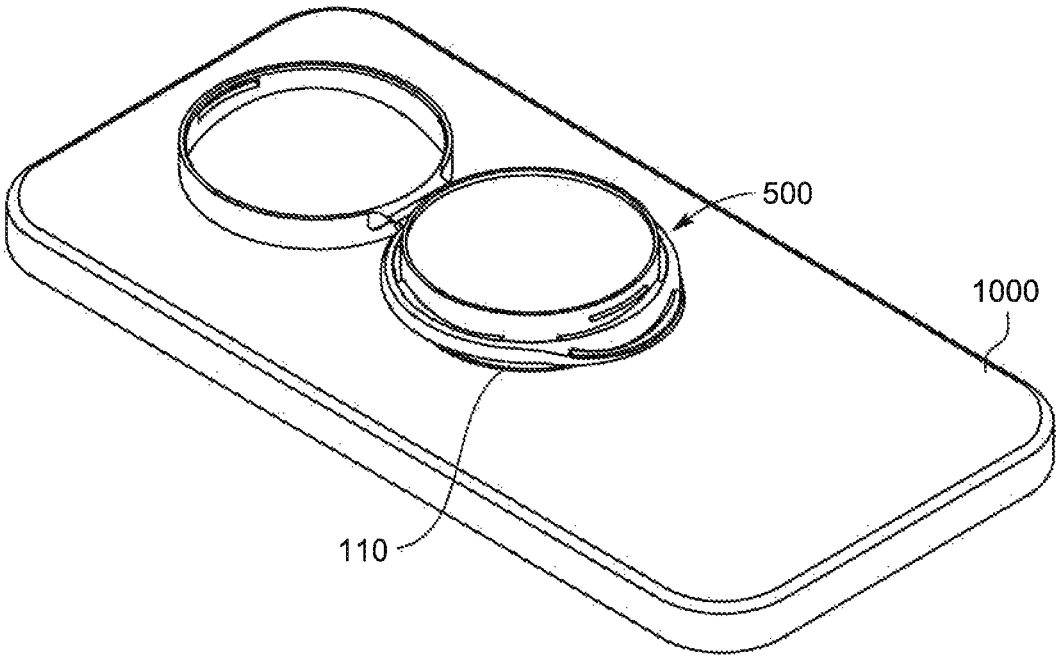
FIG. 13A is a perspective view of an open product container grip affixed to an extendable handle which in turn is affixed to a mobile device according to an embodiment.
Figure 13B:
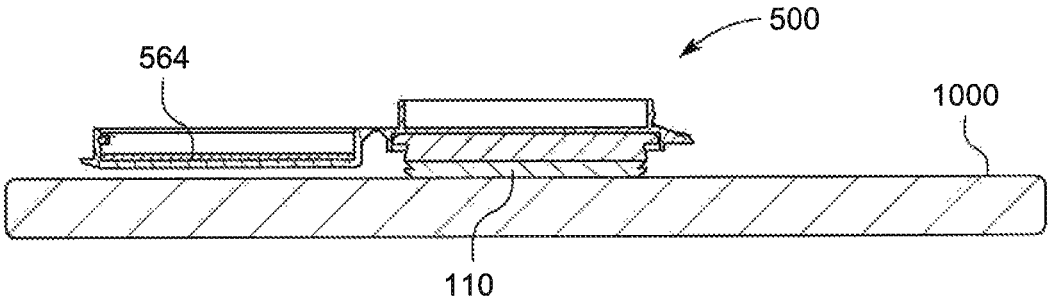
FIG. 13B is a sectional view of an open product container grip affixed to an extendable handle which in turn is affixed to a mobile device according to an embodiment.

FIGS. 12A-12N show an embodiment of the product container grip and locking mechanism of the present invention, in closed and open positions and the locking mechanism for releasably fastening the product container grip onto an extendable handle, adaptor, or any reciprocating surface; by way of example. Product container grip 500 and its parts are shown in the product container grip's open position, with bottom plate 580, living hinge 506 joining the bottom portion 502 and top portion 504 of the product container grip, and a lift 570 affixed to the top portion 504 for use in separating and joining the top portion 504 and bottom portion 502. Top portion 504 has a top wall 590 and a closure groove 540 which mates with closure projection 542 on bottom wall 595 to secure the top portion 504 and bottom portion 502 upon closure. Thumb pad 560 and thumb grip 562 aide to snap the top portion 504 and bottom portion 502 shut and assist in reopening. Bottom wall 595 defines a bottom cavity 550 with a floor. Top wall 590 defines a top cavity 575, which, optionally can house a mirror 564 FIG. 13B or other objects. FIGS. 12D-12F are bottom views of product container grip 500 with locking mechanism 508, and its details, which are used to affix product container grip 500 to the top plate 116 FIG 1A-2B. As shown in side view FIG. 12D, bottom plate 580 has an extending skirt 509 with locking mechanism 508. Bottom portion 502, further comprises bottom plate 580 and bottom base 585. FIGS. 12E-12F focus on locking mechanism 508, with exploded view 12E showing an enlarged extending skirt 509 placed near the edge of bottom plate 580. Further shown thereon at FIG. 12F, a catch 532 having arm 530 which lock onto edge 118 and the underside of the top plate 116 of the extendable handle 110. Further detailed perspectives of product container grip 500 are shown FIGS. 12G-12L, namely 12G (closed top view), 12H (closed perspective view), 12I (closed side view), 12J (closed side back vies), 12K (closed side front view and 12L (closed bottom view). This locked position is further shown in FIGS. 12M and 12N. 12M is a perspective view showing product container grip 500 closed and locked onto the top of an extendable handle 110. 12N shows a sectional view of product container grip 500 locked onto a compressed extendable handle 110 wherein amongst other features, catch 532 locks onto the underside of the top plate 116 of the extendable handle 110 and thereby fastens the product container grip 500 to the extendable handle 110 FIG. 13A is a perspective view of an open product container grip 500 affixed to an extendable handle 110 FIG. 13B which in turn affixed to a mobile device 1000. FIG. 13B is a sectional view of an open product container grip 500 affixed to an extendable handle 110 which in turn affixed to a mobile device. FIG. 13B An optional mirror 564 is placed and adhered (via glue, other adhesive, tape, and other means known to one of ordinary skill in the art) onto top cavity 575.

Figure 15A:
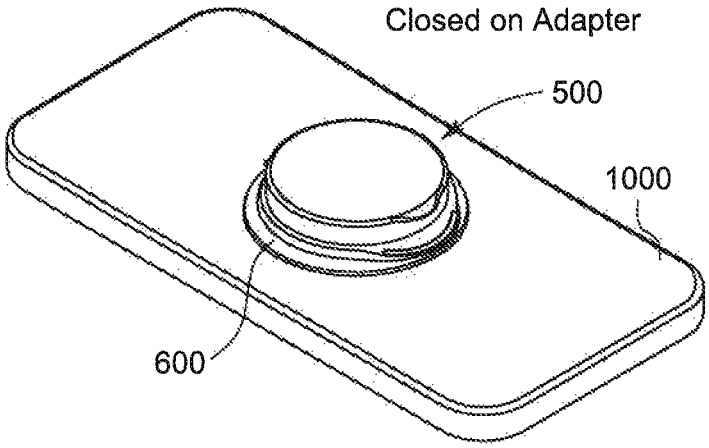
FIG. 15A is a perspective view of the product container grip closed on an adapter affixed to a mobile device according to an embodiment.
Figure 15B:
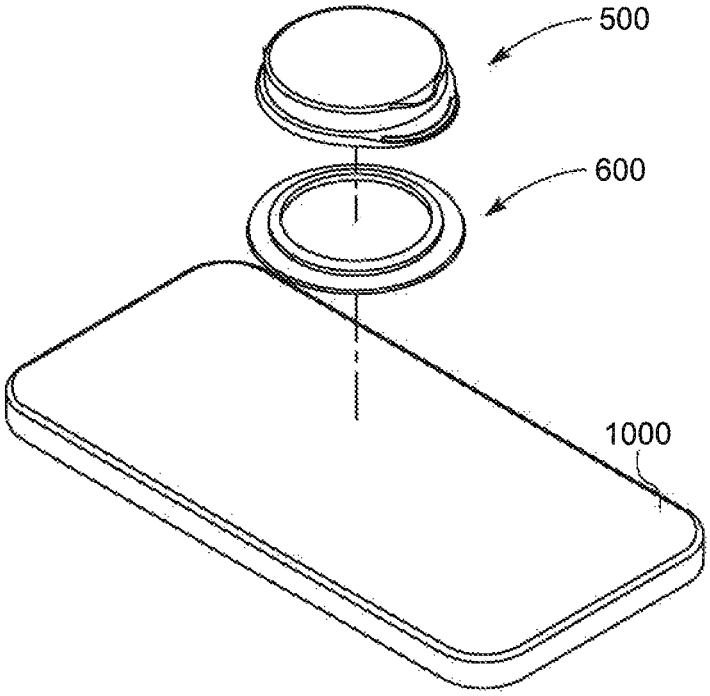
FIG. 15B is an exploded perspective view of the product container grip closed on an adapter affixed to a mobile device according to an embodiment.
Figure 15C:
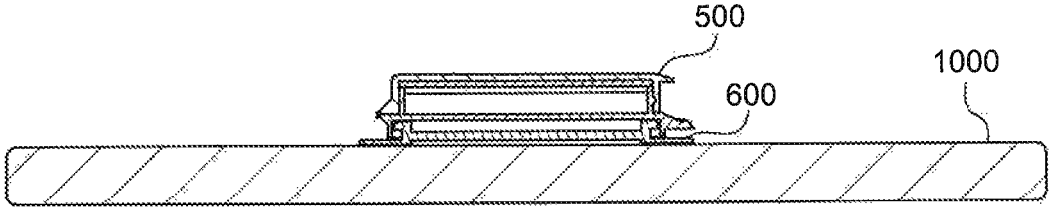
FIG. 15C is a sectional view of a closed product container grip affixed to an adapter which in turn is affixed to a mobile device according to an embodiment.
Figure 16A:
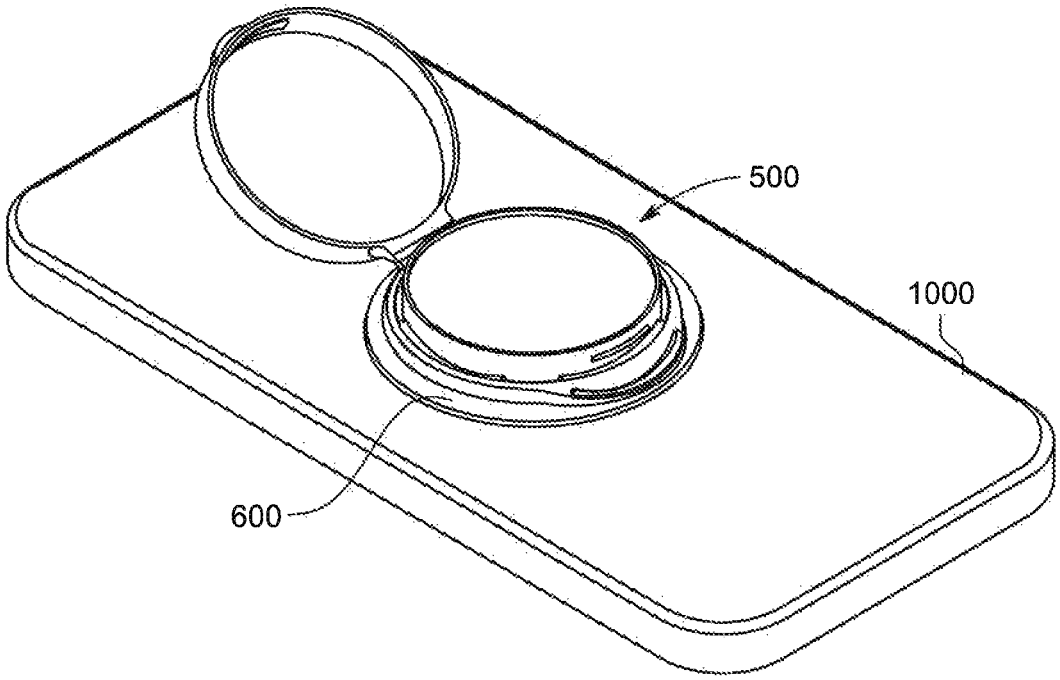
FIG. 16A is a perspective view of an open product container grip attached to an adapter which in turn is affixed to a mobile device according to an embodiment.
Figure 16B:
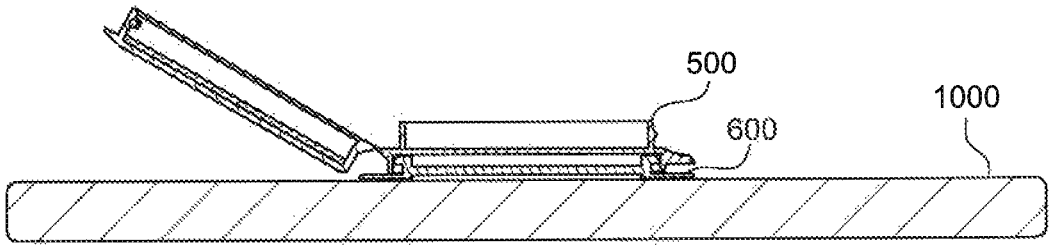
FIG. 16B is a sectional view of the open product container grip attached to an adapter Which in turn is affixed to a mobile device according to an embodiment.

FIGS. 14A-14E show an adapter 600 which can be fixed to the surface of a mobile device or other object. The adapter is mounted onto the mobile device, or the surface of another object, by a variety of means, such as glue, other adhesive, tape, and other means known to one of skill in the art. Adapter 600 receives and holds product container grip 500 such that the product container grip 500 can be affixed to any surface. In an embodiment, product container grip 500 is attached directly to adapter 600 and thus without an extendable handle 510. Adapter 600 comprises a base interior 650, base plate 685, top plate ridge 604, and bottom attachment point 602. FIG. 14D is an exploded side view showing the adapter space 618 and adapter wall 690. The adapter 600 includes top plate ridge 604 that has a larger periphery than the top potion of the adapter wall 690, thus providing a space 618 beneath the top plate ridge 604. FIGS. 15A-15C show the product container grip 500 in a closed configuration assembled onto an adapter 600 and mounted on a mobile device 1000 in accordance with the features shown in FIGS. 14A-14E. See also 15A, 15B (exploded view) and 15C (section view). FIG. 16A-16B shows the product container grip 500 in an open configuration assembled onto an adapter 600 and mounted on a mobile device 1000 16A, 16B (section view).

Figure 17A:
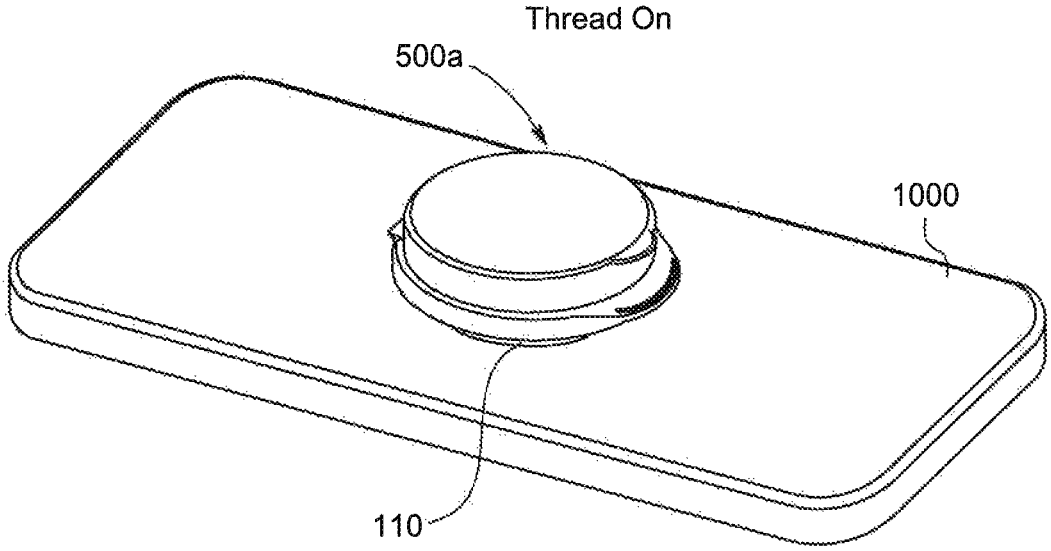
FIG. 17A is a perspective view of the product container grip attached to the top plate of an extendable handle by a threaded locking mechanism which in turn is affixed to a mobile device according to an embodiment.
Figure 17B:
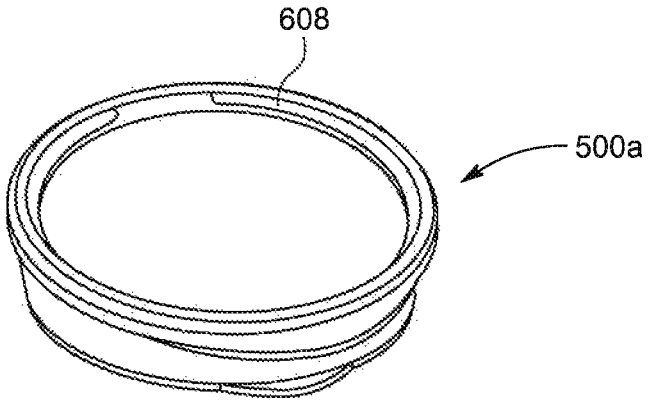
FIG. 17B is a perspective view showing the bottom and partial interior of the product container grip with a threaded interior wall locking mechanism according to an embodiment.
Figure 17C:
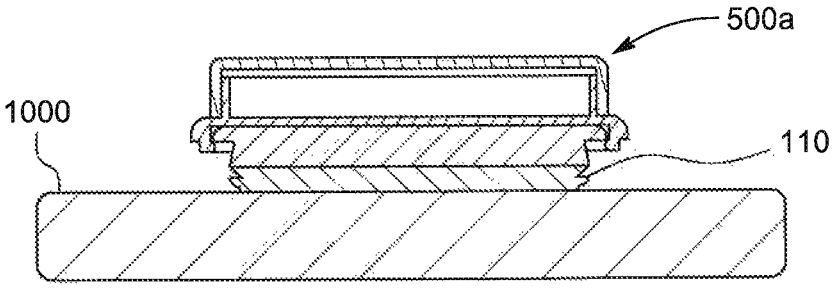
FIG. 17C is a sectional view of the product container grip with threaded locking mechanism engaging the top plate of the extendable handle which in turn is affixed to a mobile device according to an embodiment.

FIG. 17 shows another attachment mechanism wherein product container grip 500*a* is threaded onto the top plate 116 of extendable handle 110. FIG. 17B shows the threaded interior 608 attachment mechanism of product container grip 500*a*. FIG. 17C (section view) In this embodiment the product container grip 500*a* is attached onto the top plate 116 of the extendable handle 110 wherein the peripheral edge 118 of said top plate 116 acts as groove configuration to threadedly attach with the threaded interior 608.

FIG. 18 shows another attachment mechanism wherein product container grip 500*b* slides onto the top plate 116 of extendable handle 110. FIG. 18B shows channel 708 and stop-clip 732 attachment mechanism of product container grip 500*b*. See FIG. 18C (section view). In this embodiment the product container grip 500*b* is attached onto the top plate 116 of the extendable handle 110 wherein the peripheral edge 118 of said top plate 116 slides into channel 708 and stop-clip 732 springs to secure top plate 116 within channel 708.

Figure 18A:
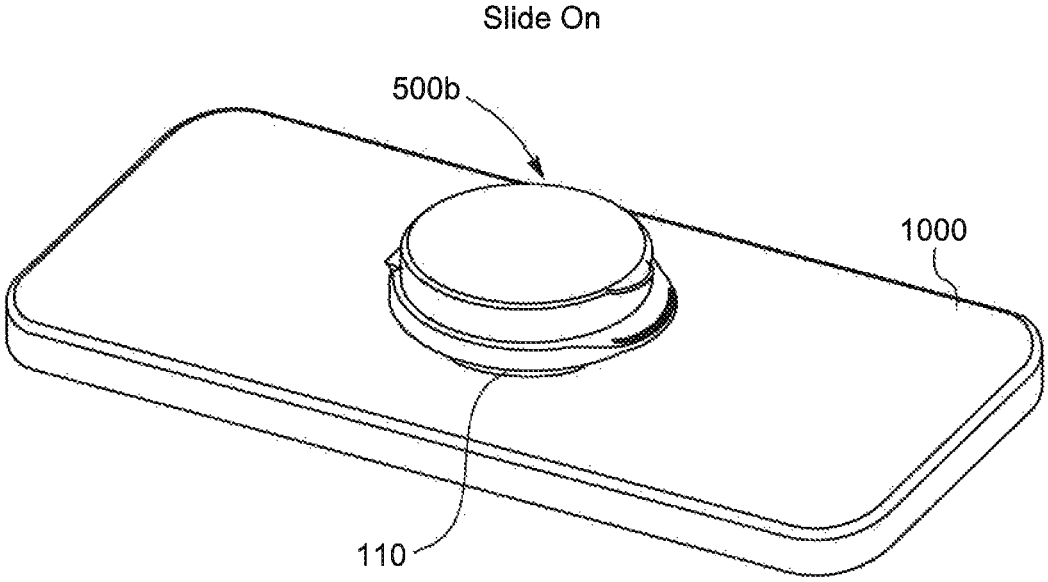
FIG. 18A is a perspective view of the product container grip attached to the top plate of an extendable handle by a slide-lock locking mechanism which in turn is affixed to a mobile device according to an embodiment.
Figure 18B:
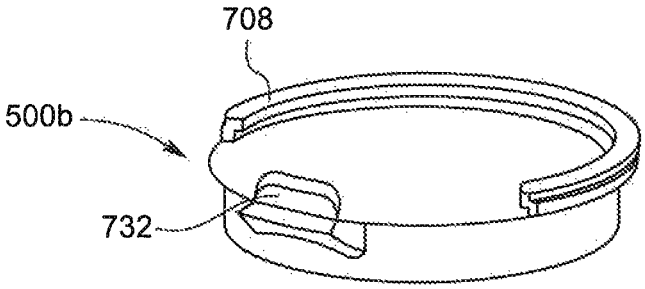
FIG. 18B is a perspective view showing the bottom and partial interior of the product container grip with a slide-lock locking mechanism o according to an embodiment.
Figure 18C:
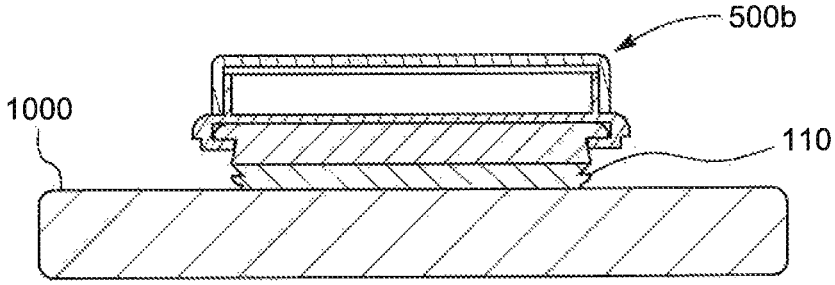
FIG. 18C is a sectional view of the product container grip with slide-lock. locking mechanism engaging the top plate of the extendable handle which in turn is affixed to a mobile device according to an embodiment.
Figure 18D:
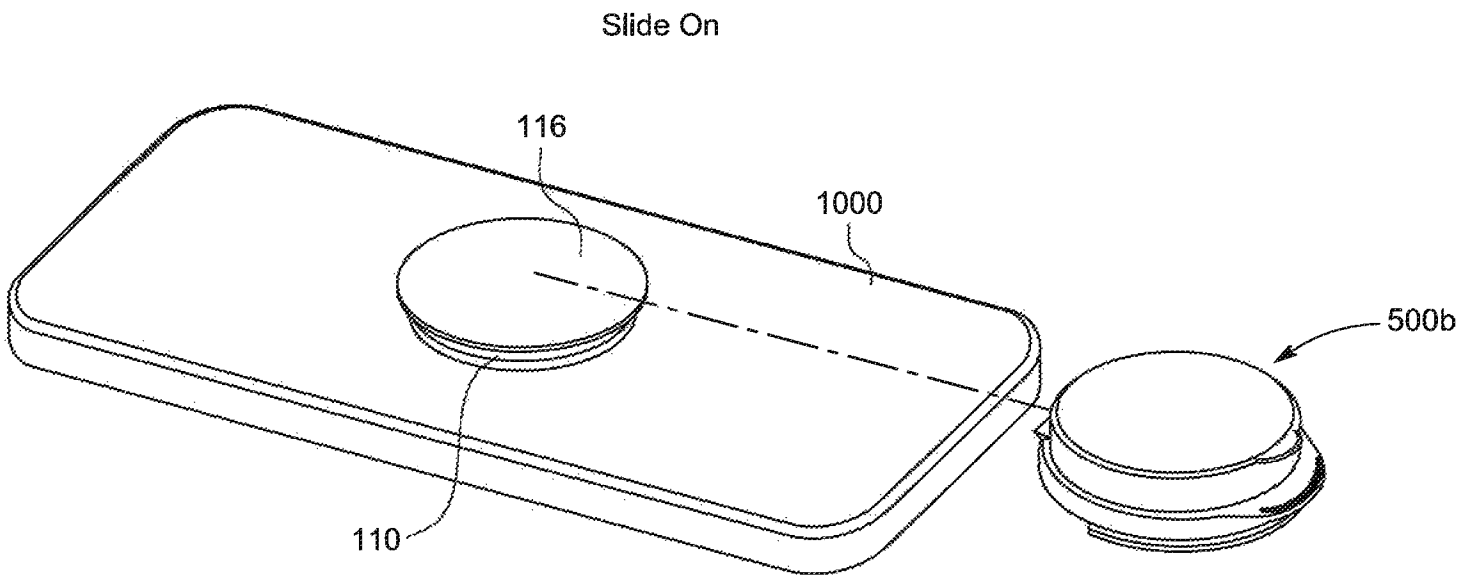
FIG. 18D is a perspective view of the product container grip with slide-lock locking mechanism which slides over and attaches to the top plate of the extendable handle which in turn is affixed to a mobile device according to an embodiment.

As shown in FIG. 18D, the bottom of product container grip 500*b* and channel 708 slide over and accepts the top plate 116 of the extendable handle 110 within channel 708 wherein the stop-clip 732 locks onto the top plate 116.

Figure 19A:
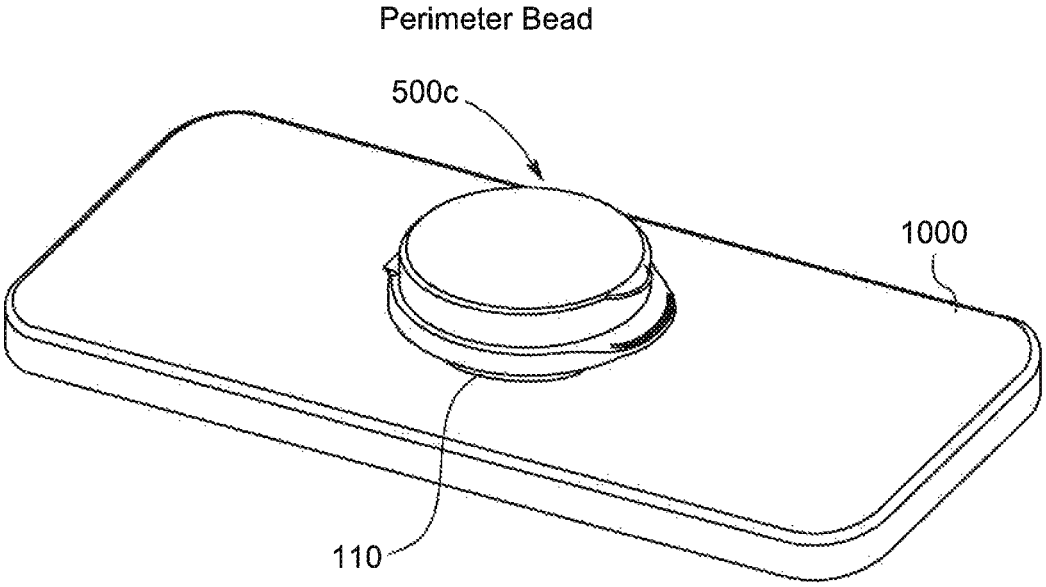
FIG. 19A is a perspective view of the product container grip attached to the top plate of an extendable holder by a perimeter bead locking mechanism which in turn is affixed to a mobile device according to an embodiment.
Figure 19B:
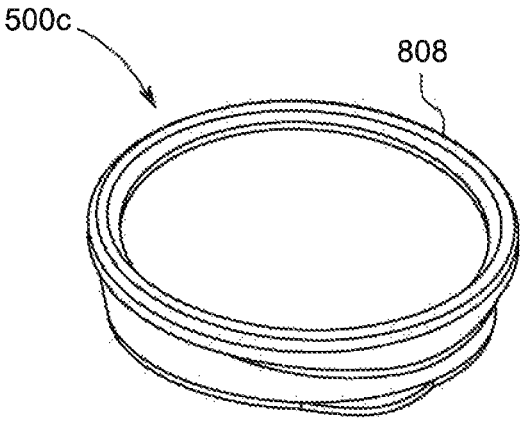
FIG. 19B is a perspective view showing the bottom and partial interior of the product container grip with a perimeter bead locking mechanism according to an embodiment.
Figure 19C:
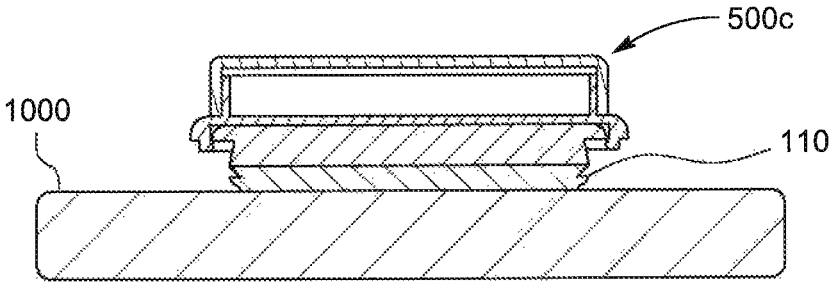
FIG. 19C is a sectional view of the product container grip with perimeter bead locking mechanism engaging the top plate of the extendable handle which in turn is affixed to a mobile device according to an embodiment.

FIG. 19 shows another attachment mechanism wherein product container grip 500*c* pushes onto the top plate 116 of extendable handle 110. FIG. 19B shows perimeter bead 808 of product container grip 500*c*. FIG. 19C (section view). In this embodiment the product container grip 500*c* is attached onto the top plate 116 of the extendable handle 110 wherein the peripheral edge 118 of said top plate 116 pushes onto perimeter bead 808 to secure top plate 116 with a downward force.

Figure 20A:
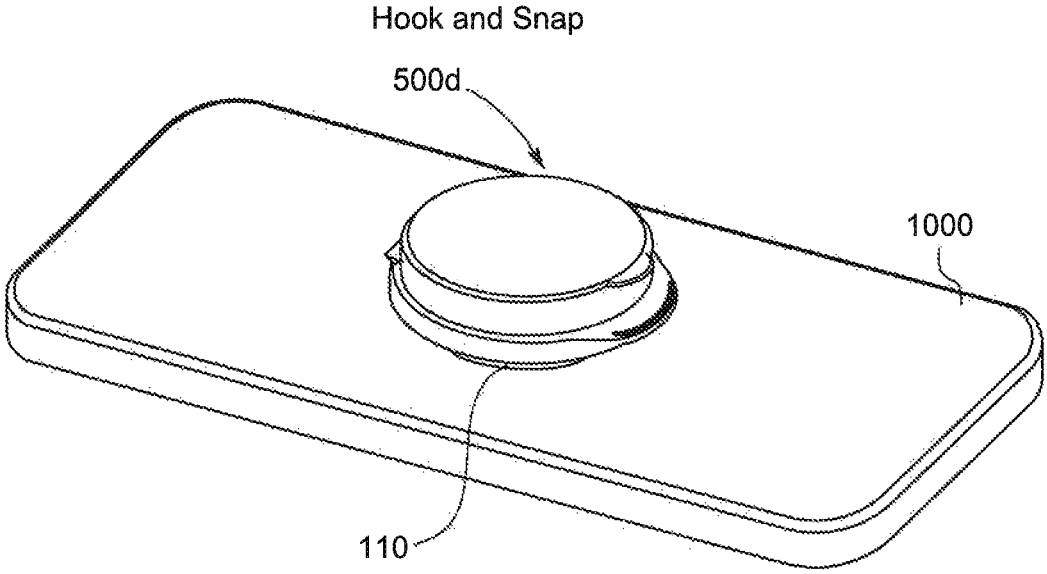
FIG. 20A is a perspective view of the product container grip attached to the top plate of an extendable holder by a hook and snap locking mechanism which in turn is affixed to a mobile device according to an embodiment.
Figure 20B:
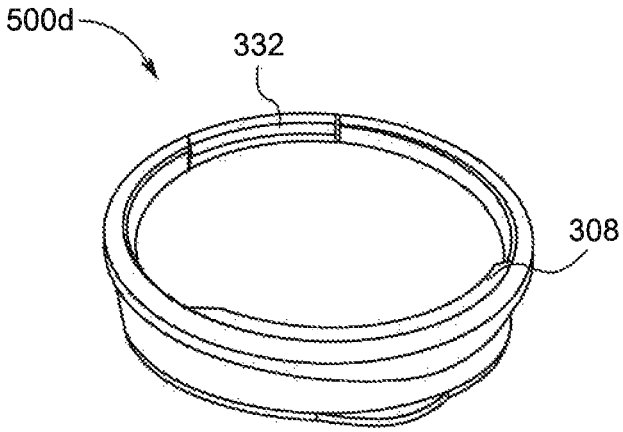
FIG. 20B is a perspective view showing the bottom and partial interior of the product container grip with a hook and snap locking mechanism according to an embodiment.
Figure 20C:
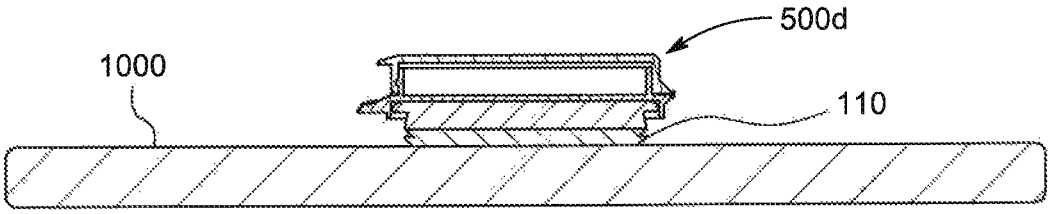
FIG. 20C is a sectional view of the product container grip with a hook and snap locking mechanism engaging the top plate of an extendable handle which in turn is affixed to a mobile device according to an embodiment.

FIG. 20 shows another attachment mechanism wherein product container grip 500*d* is hooked and snapped onto the top plate 116 of extendable handle 110. FIG. 20B shows the base shelf 308 and base clip 332 attachment mechanism of product container grip 500*d*. See FIG. 20C (section view). In this embodiment the product container grip 500*d* is attached onto the top plate 116 of the extendable handle 110 wherein the peripheral edge 118 of said top plate 116 rests on base shelf 308 and base clip 332 locks onto top plate 116.

While FIGS. 1A-20 show embodiments in which the extendable container 120, 420, 920 has a circular configuration, it should be well understood that the extendable container 120, 420, 920 may be configured in any suitable shape while remaining within the scope of this disclosure. For example, the product container grip (e.g., 100, 400, 500 900, 1100) and the extendable handle wall (e.g., 112, 412, 912) may have a rectangular, square, triangular, or other suitable shape.

In some embodiments, the product container grip (e.g., 100, 400, 500, 900, 1100) is integrally formed with the extendable handle 110. For example, the product container grip (e.g., 100, 400, 500, 900, 1100) and the wall (e.g., 112, 412, 912) may comprise a single integral unit. In embodiments that comprise a top plate 116, the product container grip (e.g., 100, 400, 500, 900, 1100), top plate 116, and the wall (e.g., 112, 412, 912) may comprise a single integral unit. In some examples, the product container grip (e.g., 100, 400, 500, 900, 1100), the wall (e.g., 112, 412, 912), and the base (e.g., 114, 414, 914) are integrally formed. In embodiments that comprise a top plate 116, the product container grip (e.g., 100, 400, 500, 900, 1100), top plate (e.g., 116), the wail (e.g., 112, 412, 912), and the base (e.g., 114, 414, 914) may comprise a single integral unit.

The product container grip (e.g., 100, 400, 500, 900, 1100) may comprise any suitable type of one or more materials. In some embodiments, the product container grip (e.g., 100, 400, 500, 900, 1100) comprises a cardboard or metal material (e.g., tin). In some embodiments, the product container grip (e.g., 100, 400, 500, 900, 1100) comprises a polymeric material. The product container grip (e.g., 100, 400, 500, 900, 1100) may be made out of any material known to one of ordinary skill in the art.

In some embodiments, the product container grip (e.g., 100, 400, 500, 900, 1100) is formed as an integral unit. For example, the top portion 104, 404, 504, 904, 1104 and bottom portion 102, 402, 502, 902, 1102 and hinge 106, 406, 506, 1106 may be formed as a single, integral unit. In other embodiments, the product container grip (e.g., 100, 400, 500, 900, 1100) is formed as a plurality of units. For example, the top portion 104, 404, 504, 904, 1104 and bottom portion 102, 402, 502, 902, 1102 and/or hinge 106, 406, 506, 1106 may be formed as separate units and then attached to one another, Additionally or alternatively, several units may be attached to create at least one of the top portion 104, 404, 504, 904, 1004 and bottom portion 102, 402, 502, 902, 1102, or hinge 106, 406, 506, 1106. In embodiments not comprising a hinge, the top portion 104, 404, 504, 904, 1104 and bottom portion 102, 402, 502, 902, 1102 may be formed as separate units.

The product container grip (e.g., 100, 400, 500, 900, 1100) may be made from any suitable type of process to one of ordinary skill in the art. In some embodiments, at least part of the product container grip (e.g., 100, 400, 500, 900, 1100) is formed by three-dimensional printing or computer numerical control "CNC." In some embodiments, at least part of the product container (e.g., 100, 400, 500, 900, 1100) is formed through molding, such as injection molding, (stamping of tin). In addition, an embodiment of the present is designed first on paper and then on a computer using Computer Aided Design ("CAD") software. Two dimensional drawings can be made in CAD. Once finalized drawings are approved, a 3D rendering can be made in CAD. Once approved, a 3D printed model can be made out of polypropylene. In accordance with procedures utilized by one of ordinary skill in the art, the model can be evaluated, discussed, modified, and improvements can be made, as well as additional drawings, until a final model is agreed upon and printed. In another embodiment, a CNC machine can generate the polypropylene model instead of a 3D printer. In still another embodiment a mirror 564 is attached to the inside cavity 575 of top portion 504 of the product container grip 500.

Design considerations in making the product of the present invention generally include how can a product container be easily attached and removed from a mobile device. The popularity of PopSockets®, SpinPops®, PopGrips® and other extendable handles and the space they dominate on the back of a mobile phone, was the precursor to many of the embodiments disclosed herein. Design considerations also include figuring out how to attach a product container onto an extendable handle that would easily attach and detach from the extendable handle. In connection with the present invention, a snap on (or other attachment mechanism discussed above) configuration was deemed to be practical, economical and preferred scenario to accomplish a versatile on/off configuration. However, as shown in the figures herein and related descriptions, many iterations of attachment were taken into consideration. The product design started, pen on paper, then Microsoft software (PowerPoint and Paint) were used, and then 2D CAD drawings were furnished. Once 2D drawings were approved, a 3D CAD model was designed and a sample piece was CNC machined out of polypropylene.

Some of the issues and solutions considered during the design and modeling of the present invention were:

How to keep the top and bottom of the container attached so two hands were not needed—solution: living hinge How to keep the top secured onto the bottom—solution: groove and lip How to facilitate ease of opening, when top was secured—solution: thumb pad How to insure thumb doesn't slip off thumb pad—solution: thumb grip How to facilitate ease of opening top lid—solution: added lift How to ensure lift isn't activated in error—solution: rounded lift and minimized size, created slight angle off top to minimize sharp edge What if an extendable handle was not used—solution: Adapter How to snap product on/off an extendable handle & adapter—solution: Locking; attachment/grip mechanisms How to insure locking/attachment/grip mechanisms engaged with proper force—solution: Arm and Catch and other grips were tested and approved How to maximize fill size without compromising functionality—solution: Multiple prototypes testing different size scenarios with fill size calculations implemented.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

Unless otherwise noted, the terms "connected", "attached", "locked" "coupled" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

The invention claimed is:

1. A product comprising:

an adapter for being secured to the object;

a container that is a separate part relative to the adapter and is configured to attach to the adapter to form the container assembly, the container comprising:

a container bottom having a first container wall forming a first cavity, wherein the first container wall has a first diameter, a container top releasably attached to said first container wall by a hinge and the container top is movable between an open position and a closed position relative to the container bottom, the container top including a second cavity and being defined by a second diameter;

a container bottom plate integral with said first container wall and having a third diameter that is greater than the first diameter resulting in the container bottom plate completely surrounding the first container wall and lying below the first container wall so as to define a bottom of the first cavity;

wherein in the closed position, the container top surrounds the first container wall and seats against an upper surface of the container bottom plate which surrounds the container top since the third diameter is greater than the second diameter;

a locking mechanism non-removably attached on the container bottom plate and disposed below the container bottom plate, and wherein said locking mechanism is configured to releasably lock said container onto the adapter that is a separate part from said container;

wherein the adapter includes an adapter base plate and an upstanding adapter plate ridge that protrudes immovably above the adapter base plate, the adapter base plate extending radially outward from the adapter plate ridge and including a flat bottom surface for seating against the object to secure the adapter to the object, wherein the locking mechanism is configured to releasably lock the container onto the adapter plate ridge, wherein the adapter base plate has a fourth diameter that is greater than the third diameter.

2. The product of claim 1, wherein said locking mechanism is a threaded device.

3. The product of claim 1, wherein said locking mechanism is a slide-on locking device.

4. The product of claim 1, wherein said locking mechanism is comprised of a perimeter bead.

5. The product of claim 1, wherein said locking mechanism is a hook and snap mechanism.

6. The product of claim 1, wherein said locking mechanism comprises one or more biased catches.

7. The product of claim 1, wherein said locking mechanism comprises protrusions and apertures which fit each other in a male-female arrangement.

8. The product of claim 1, wherein the container bottom includes a skirt formed along an underside of the container bottom plate.

9. The product of claim 8, wherein the skirt has an annular shape and the locking mechanism comprises a plurality of biased catches that are interspersed along the skirt.

10. The product of claim 1, wherein the flat bottom surface includes an adhesive tape for securing the adapter to the object.

11. The product of claim 10, wherein the container bottom plate includes a thumb pad that extends radially outward a greater distance from the first container wall than other portions of the container bottom plate.

12. The product of claim 11, wherein the thumb pad and hinge are directed opposite one another.

13. The product of claim 12, wherein the locking mechanism comprises a plurality of biased catches that extend downwardly from the container bottom plate, the plurality of biased catches being located between the thumb pad and the hinge.

14. The product of claim 1, wherein the container top has a second cavity in which a mirror is disposed.

15. The product of claim 1, wherein the container top includes a second container wall that seats against the container bottom plate when the container is in a closed position.

16. The product of claim 1, wherein the locking mechanism comprises a plurality of biased catches that extend downwardly from the container bottom plate, each biased catch having an arcuate shape.

17. The product of claim 1, wherein the adapter plate ridge defines an undercut space into which a catch of the locking mechanism is received for releasably locking the container onto the adapter.

18. The product of claim 1, wherein the adapter plate ridge defines a hollow cavity located above the container adapter base plate.

19. The cosmetic product of claim 1, wherein an annular space is formed between the adapter base plate and the upstanding adapter plate ridge and the locking mechanism is received within the annular space to lock the container to the adapter.

* * * * *